US008007561B2

(12) United States Patent
Shindo et al.

(10) Patent No.: US 8,007,561 B2
(45) Date of Patent: Aug. 30, 2011

(54) CERMET INSERT AND CUTTING TOOL

(75) Inventors: Tomoaki Shindo, Nagoya (JP); Atsushi Komura, Kiyosu (JP); Hiroaki Takashima, Komaki (JP); Toshiyuki Taniuchi, Toride (JP); Masafumi Fukumura, Toride (JP); Kei Takahashi, Tsukuba (JP)

(73) Assignees: NGK Spark Plug Co., Ltd., Aichi (JP); Mitsubishi Materials Corporation, Tokyo (JP)

( * ) Notice: Subject to any disclaimer, the term of this patent is extended or adjusted under 35 U.S.C. 154(b) by 763 days.

(21) Appl. No.: 11/917,472

(22) PCT Filed: Jun. 13, 2006

(86) PCT No.: PCT/JP2006/311864

§ 371 (c)(1),
(2), (4) Date: May 28, 2008

(87) PCT Pub. No.: WO2006/134936

PCT Pub. Date: Dec. 21, 2006

(65) Prior Publication Data

US 2009/0049953 A1 Feb. 26, 2009

(30) Foreign Application Priority Data

| | | |
|---|---|---|
| Jun. 14, 2005 | (JP) | 2005-173463 |
| Sep. 7, 2005 | (JP) | 2005-259169 |
| Sep. 7, 2005 | (JP) | 2005-259170 |
| Sep. 7, 2005 | (JP) | 2005-259171 |
| Oct. 18, 2005 | (JP) | 2005-303095 |
| Oct. 18, 2005 | (JP) | 2005-303096 |

(51) Int. Cl.
*C22C 29/04* (2006.01)

(52) U.S. Cl. ..... 75/238; 75/239; 75/240; 75/244

(58) Field of Classification Search ..... 75/238, 75/239, 240
See application file for complete search history.

(56) References Cited

U.S. PATENT DOCUMENTS

| | | | | | |
|---|---|---|---|---|---|
| 4,957,548 | A | * | 9/1990 | Shima et al. | 75/238 |
| 4,985,070 | A | * | 1/1991 | Kitamura et al. | 75/238 |
| 5,149,361 | A | * | 9/1992 | Iyori et al. | 75/233 |
| 5,370,719 | A | * | 12/1994 | Teruuchi et al. | 51/309 |
| 5,670,726 | A | * | 9/1997 | Kolaska et al. | 75/237 |
| 5,766,742 | A | | 6/1998 | Nakamura et al. | |

FOREIGN PATENT DOCUMENTS

| | | | |
|---|---|---|---|
| EP | 0819776 | A1 | 1/1998 |
| JP | 9-1405 | A | 1/1997 |
| JP | 10110234 | A | 4/1998 |
| JP | 2775646 | B2 | 5/1998 |
| JP | 2002263940 | A | 9/2002 |
| JP | 2004292842 | A | 10/2004 |
| JP | 2006-346776 | A | 12/2006 |
| JP | 2007-069309 | A | 3/2007 |

* cited by examiner

*Primary Examiner* — Roy King
*Assistant Examiner* — Ngoclan T Mai
(74) *Attorney, Agent, or Firm* — Sughrue Mion, PLLC

(57) ABSTRACT

A cermet insert having a structure composed of a hard phase and a binding phase and, as a sintered body composition, containing Ti, Nb and/or Ta, and W in a total amount of Ti in terms of carbonitride, Nb and/or Ta in terms of carbide and W in terms of carbide of 70 to 95 wt. % of an entirety of the microstructure, and containing W in terms of carbide in an amount of 15 to 35 wt. % of the entirety of the microstructure, the sintered body composition further containing Co and/or Ni. The hard phase has one or two or more of the phases: (1) a first hard phase of a core-having structure whose core portion contains a titanium carbonitride phase and a peripheral portion containing a (Ti, W, Ta/Nb)CN phase, (2) a second hard phase of a core-having structure whose core portion and peripheral portion both contain a (Ti, W, Ta/Nb)CN phase, and (3) a third hard phase of single-phase structure including a titanium cabonitride phase. Moreover, the titanium carbonitride phase includes a W-rich phase unevenly distributed in the titanium carbonitride phase.

6 Claims, 16 Drawing Sheets

HARD PHASE MICROSTRUCTURE

CERMET INSERT AND CUTTING TOOL

TECHNICAL FIELD

The present invention is related to a cermet insert and a cutting tool. Particularly, the present invention is related to a cermet insert excelling in wear resistance and breakage resistance, and a cutting tool provided with such cermet insert.

BACKGROUND ART

For cutting steel and the like, a cermet insert, having a microstructure constituted with hard phases (hard particles) and a binding phase existing between the hard phases, has been conventionally used. Various techniques have been proposed in order to improve the efficiency of such cermet insert.

For example, Patent Document 1 described below suggests cermet alloy with high toughness in which breakage resistance is improved by determining the volume of particles, independently containing a metallic phase therein, to 10 vol % or larger of the entirety of a hard phase.

Moreover, Patent Document 2 described below proposes a cermet cutting tool whose breakage resistance is improved by dispersing particles inside of the cutting tool. The particles have a concentration distribution wherein the content ratio of Ti and W is higher in a core portion than in a peripheral portion, inside of the cutting tool.

Patent Document 1: Japanese Patent No. 2775646

DISCLOSURE OF THE INVENTION

Problems to be Solved by the Invention

Although the technique of the above-described Patent Document 1 can improve the breakage resistance to some extent, there has been a problem in that since heat resistance of the metallic phases in the particles is low, the hardness of the hard phases is decreased, and the wear resistance is reduced.

Moreover, in the technique of the above-described Patent Document 2, although the adhesion strength between the binding phase and the hard phase is high, there has been a similar problem in that the hardness of the hard phases is decreased and the wear resistance is reduced.

The present invention is made in consideration of the above-described problems. The purpose of the invention is to provide a cermet insert and a cutting tool in which high wear resistance can be maintained and high breakage resistance can be also achieved.

Means for Solving the Problems

The invention (cermet insert) according to claim 1 proposed for solving the above-described problems includes a microstructure including a hard phase and a binding phase. The cermet insert includes Ti, Nb and/or Ta, and W as much as that a sum of an amount of Ti converted as carbonitride, an amount of Nb and/or Ta converted as carbide, and an amount of W converted as carbide is 70-95 mass % of an entirety of the microstructure (in which the amount of W converted as carbide is 15-35 mass % of the entirety of the microstructure) as a sintered body composition. The cermet insert further includes Co and/or Ni as the sintered body composition. The hard phase includes one kind or two or more kinds of phases selected from (1)-(3) (except for a singularity of (2)), in which (1) a first hard phase is provided with a core-having structure in which a core portion includes a titanium carbonitride phase, and a peripheral portion includes a (Ti, W, Ta/Nb)CN phase, (2) a second hard phase is provided with a core-having structure in which both of a core portion and a peripheral portion include a (Ti, W, Ta/Nb)CN phase; and (3) a third hard phase is provided with a single-phase structure comprising a titanium carbonitride phase.

The titanium carbonitride phase includes W-rich phases, which are rich in W as compared to a surrounding thereof, and unevenly distributed in the titanium carbonitride phase.

The cermet insert according to the present invention is, as schematically shown in FIG. 1, comprising a microstructure substantially including the hard phase (hard particles) and the binding phase surrounding the hard phase.

The following explains a reason why the sum of the respective converted amounts of Ti, Nb and/or Ta, and W forming the hard phase is determined to be 70-95 mass % in the present invention. It is to be noted that the respective converted amounts are an amount of Ti converted into TiCN, an amount of Nb and/or Ta converted into (Nb/Ta)CN, and an amount of W converted into WC.

The reason is, first of all, that when the rate of the hard phase exceeds 95 mass % of the entire cermet, the rate of the binding phase consequently becomes less than 5 mass %, which results in a reduction of the toughness of a cermet and therefore causes a reduction of the breakage resistance thereof, while complex carbonitride and carbonitride forming the hard phase (hard particles) improve the hardness of the cermet, and thus improves wear resistance thereof. On the other hand, the reason is that when the rate of the hard phase is less than 70 mass %, the rate of the binding phase consequently becomes over 30 mass %, which causes a deterioration of wear resistance of the cermet.

Moreover, by containing W (converted into WC) as much as 15-35 mass % of the entire microstructure, the wear resistance and the breakage resistance of an insert can be improved.

Furthermore, Co improves the sinterability, forms the binding phase, and improves the strength of an insert. Ni forms the binding phase during wintering, improves the heat resistance of the binding phase, and therefore improves the wear resistance of an insert.

Additionally, due to the hard phase including phases selected from the 3 kinds of hard phases described above, the hardness of an insert can be increased and therefore the wear resistance of the insert can be increased.

Particularly, in the present invention, the W-rich phases are unevenly distributed in the titanium carbonitride phases included in the aforementioned hard phases (1) and (3), as schematically shown in FIG. 2 (a result of microstructure observation by a TEM in regard to the sectional surface of the hard phase). The uneven distribution mentioned here means that W is not evenly dispersed in the titanium carbonitride phase, but W exists more in a specific portion which, as a result, constitutes the W-rich phases.

In the present invention, high wear resistance and high breakage resistance are provided due to W being unevenly distributed in the titanium carbonitride phases included in the above-described hard phases (1) and (3). The following can explain the reason for the improvement in the wear resistance and the breakage resistance.

The breakage resistance of the hard phase is improved by containing W therein. Additionally, W is not simply contained in the hard phase, but exists in the hard phase in the form of the W-rich phase. TiCN, existing in the hard phase, is divided into a block-like manner by the W-rich phase (see FIG. 3). In this block portion, a high degree of hardness, which is distinctive to TiCN, is maintained, and high wear resistance is achieved. FIG. 3 schematically shows a state wherein W enters a dislocation caused inside of the titanium carbonitride phase (in which, for example, atoms are aligned in a lattice-like manner), and the W-rich phases are formed in, for example, a planer (laminar) manner.

Therefore, due to a specific amount of W existing in the hard phase, and W-rich phases existing in the titanium carbonitride phase in an uneven manner, a remarkable effect is accomplished, in which high wear resistance and high breakage resistance can be both achieved.

It is to be noted that "A and/or B" mentioned above means at least one of A and B (the same applies hereinafter).

The invention according to claim 2 is characterized in that, in the microstructure of at least one of a surface and a sectional surface of the cermet insert, the W-rich phases are unevenly distributed in the titanium carbonitride phase in at least one of a string-like manner and a mesh-like manner.

The present invention exemplifies the state of uneven distribution of the W-rich phases in two dimension. In other words, the present invention exemplifies the state of the W-rich phases which appear in the surface or the sectional surface of the insert.

As shown in the aforementioned FIG. 3, the W-rich phases are unevenly distributed in a string-like and a mesh-like manners in the titanium carbonitride phases contained in (1) first hard phase and (3) third hard phase. In a TEM photograph, the W-rich phases are shown, for example, by white lines and the like.

That is, in the present invention, the W-rich phases can be two-dimensionally observed, as a result of, for example, microstructure observation by a TEM, in a string-like manner and a mesh-like manner. This is thought because end surfaces of the W-rich phases, existing in, for example, a laminar manner in the titanium carbonitride phase, are observed in a string-like manner and a mesh-like manner in the surface or the sectional surface of the insert.

If the W-rich phases exist in an oblique manner on the longitudinal section of a thin film made with a sample used for TEM observation, the W-rich phases are observed, as shown in for example FIG. 4, as a white line having a width H in a TEM photograph.

The invention according to claim 3 is characterized in that the W-rich phases are unevenly distributed in the titanium carbonitride phase in at least one of a laminar manner, a columnar manner, and a prismatic manner.

The present invention exemplifies the state of uneven distribution of the W rich phases in three dimension.

The state of the uneven distribution in the laminar, columnar, and prismatic manners may comprise, for example, flat surfaces or curved surfaces. These surfaces may be provided with holes. These W-rich layers may exist in a state wherein a plurality of laminar W-rich phases, columnar W-rich phases, and prismatic W-rich phases are mixed. That is, the W-rich phases may exist in a state wherein, for example, scale-like shaped W-rich phases or W-rich phases formed in a shape of a number of bubbles are gathered together.

If the W-rich phases are unevenly distributed in a laminar manner, and observed by a TEM from a direction perpendicular to the layers, the W-rich phases are observed, as shown in FIG. 9, as white flat surfaces having a specific expanse. Around the white flat surfaces, white lines, constituting other W-rich phases, are generally observed in a string-like manner or a mesh-like manner.

The invention according to claim 4 is characterized in that the hard phase and/or the binding phase contain(s) Mo.

By containing Mo, wettability of the hard phase and the binding phase can be increased. Therefore, a sinterability can be improved.

The invention according to claim 5 is characterized in that the binding phase contains W as much as 40-60 mass % of an entirety of the binding phase.

Since W is contained 40-60 mass % in the binding phase in the present invention, the high-temperature hardness of the binding phase is improved. Therefore, excellent wear resistance can be exercised in, for example, a high-speed cutting process which involves generation of high heat.

The invention according to claim 6 (cutting tool) includes a holder provide with the cermet insert according to one of claims 1 to 5.

Since the cutting tool according to the present invention is provided with the above-described cermet insert in the holder, the tool excels in wear resistance and breakage resistance.

The following composition may be also adopted as a preferred embodiment of the present invention as described in the applicant's earlier application: Japanese Patent Application No. 2005-173463.

For example, for the insert, "a sintered body of a compact having a blended composition comprising tungsten carbide: 20-30 mass %, tantalum carbide and/or niobium carbide: 5-10 mass %, Co: 5-10 mass %, Ni: 5-10 mass %, titanium carbonitride: the remainder (however, the content has to be 50-60 mass %)" may be adopted.

Furthermore, for the sintered body, for example, "a composition having a microstructure comprising a hard phase: 75-90 area %, and a binding phase: the remainder according to microstructure observation by a scanning electron microscope" may be adopted.

Additionally, for the binding phase, "a composition containing Co: 18-33 mass %, Ni: 20-35 mass %, Ti, Ta and/or Nb: 5 mass % or less, W: the remainder (however, the content has to be 40-60 mass %) in the binding phase" may be adopted.

It is to be noted that the remainder portion of the composition generally contains inevitable impurities.

EXPLANATION OF REFERENTIAL NUMERALS

1 . . . insert
3 . . . holder
5 . . . fixture
7 . . . cutting tool

DETAILED DESCRIPTION OF PREFERRED EMBODIMENTS OF THE INVENTION

The following describes preferred embodiments of the present invention, that is, embodiments of the cermet insert and the cutting tool.

Embodiment 1 a) Firstly, a cermet insert according to the present embodiment (to be simply referred to as an insert) is described.

Figure 5:
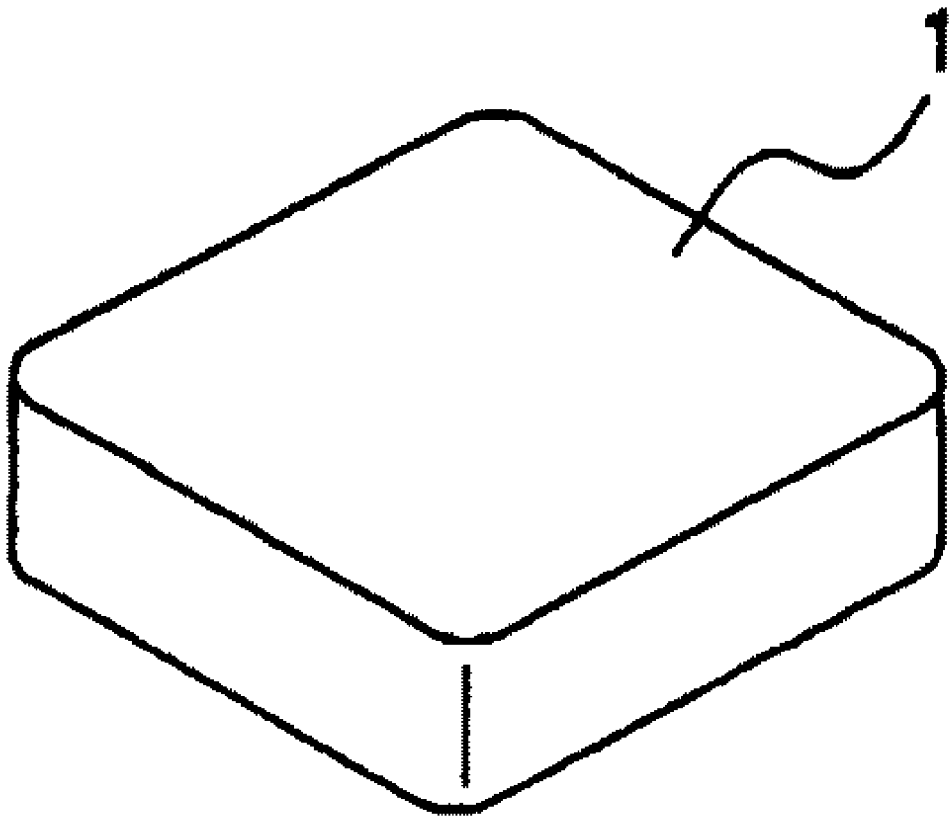
FIG. 5 is a perspective view showing a cermet insert according to Embodiment 1.

As shown in FIG. 5, an insert 1 according to the present embodiment is a cutting tip made with a sintered body shaped in compliance with the ISO standard SNGN120408.

Figure 1:
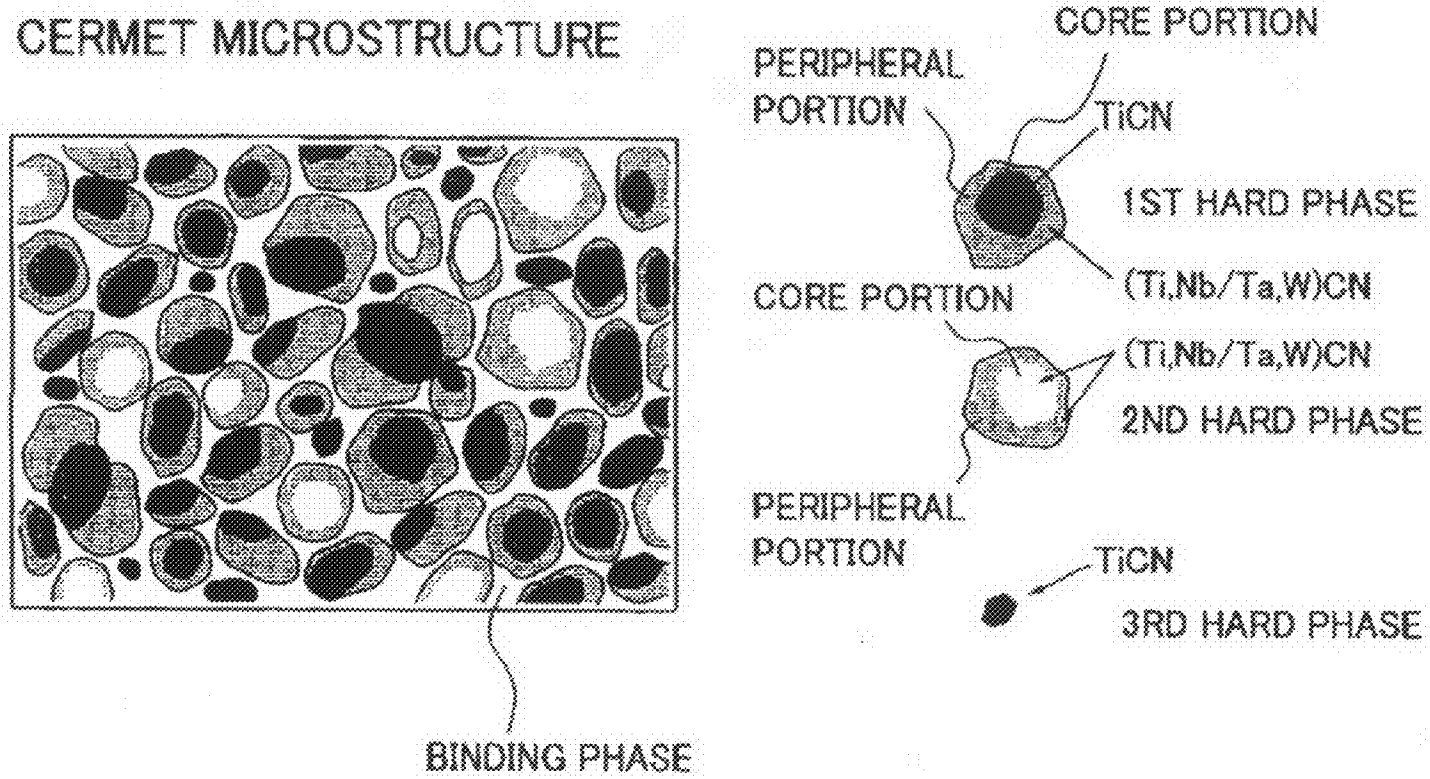
FIG. 1 is an explanatory view schematically showing a sectional surface of a cermet insert according to the present invention.

The insert 1 is constituted with, as shown in the above-described FIG. 1, a microstructure including hard phases (hard particles) and a binding phase existing 80 as to surround the hard phases (the microstructure contains inevitable impurities).

In the composition of the sintered body of the insert 1, Ti, Nb and/or Ta, and W are contained such that a sum of an amount of Ti converted as carbonitride, an amount of Nb and/or Ta converted as carbide, and an amount of W converted as carbide, becomes 70-95 mass % of the entire insert. In the composition, W is contained as much as the amount of W converted as carbide becomes 15-35 mass % of the entire insert. The hard phases contain, as described later, titanium carbonitride and complex carbonitride including Ti, W, Ta and/or Nb.

Furthermore, in the insert 1, W, Co and/or Ni are contained as the binding phase, which is a remainder portion in the microstructure excluding the hard phases. W is contained 40-60 mass % of the entire binding phase. Co is contained 18-33 mass %. Ni is contained 20-35 mass %.

Still furthermore, as the above-described hard phases, the insert 1 includes all of the hard phases described in the following (1)-(3):

(1) a first hard phase of core-having structure whose core portion contains a titanium carbonitride phase, and whose peripheral portion contains a (Ti, W, Ta/Nb)CN phase;

(2) a second hard phase of core having structure whose core portion and peripheral portion both contain a (Ti, W. Ta/Nb) CN phase; and (3) a third hard phase of single-phase structure constituted with a titanium carbonitride phase.

Figure 2:
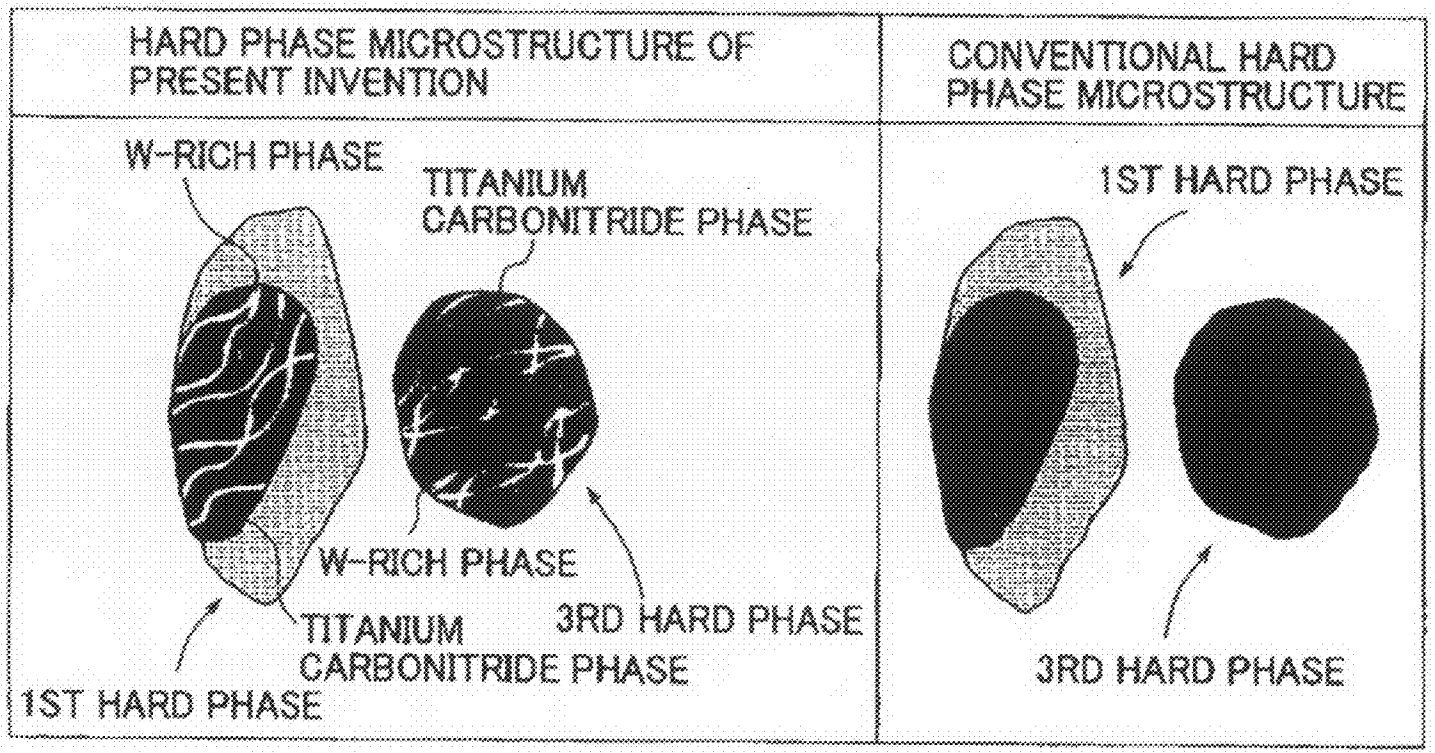
FIG. 2 is an explanatory view schematically showing sectional surfaces of hard phases according to the present invention and a conventional example.
Figure 3:
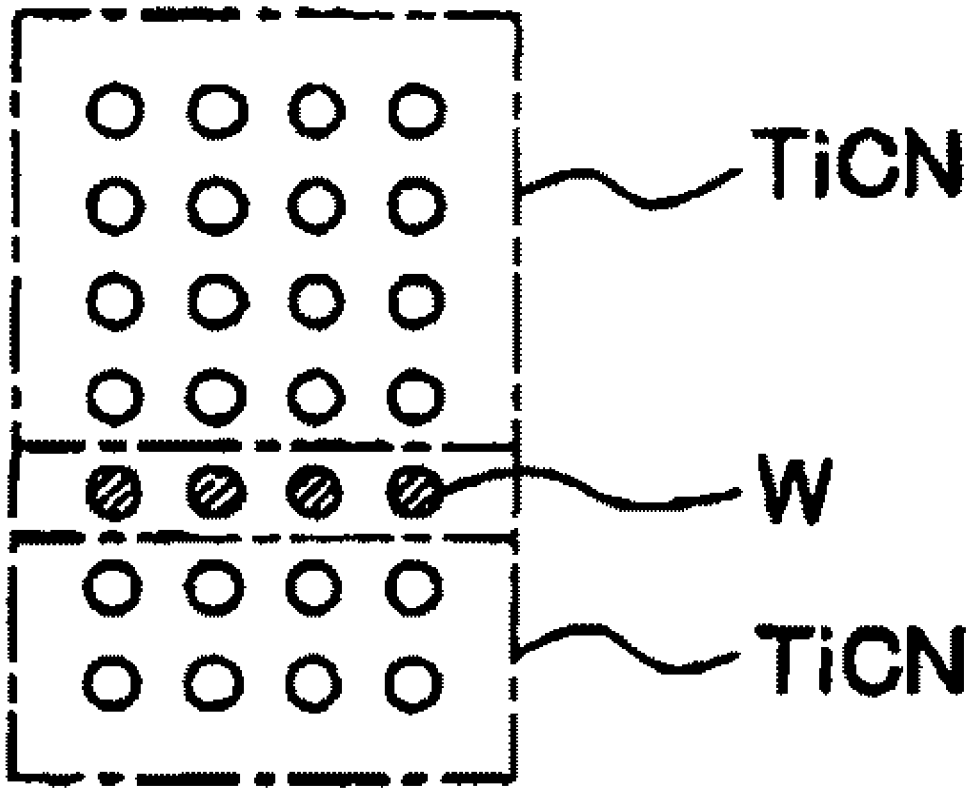
FIG. 3 is an explanatory view showing an internal structure of the hard phase of the cermet insert according to the present invention.
Figure 4:
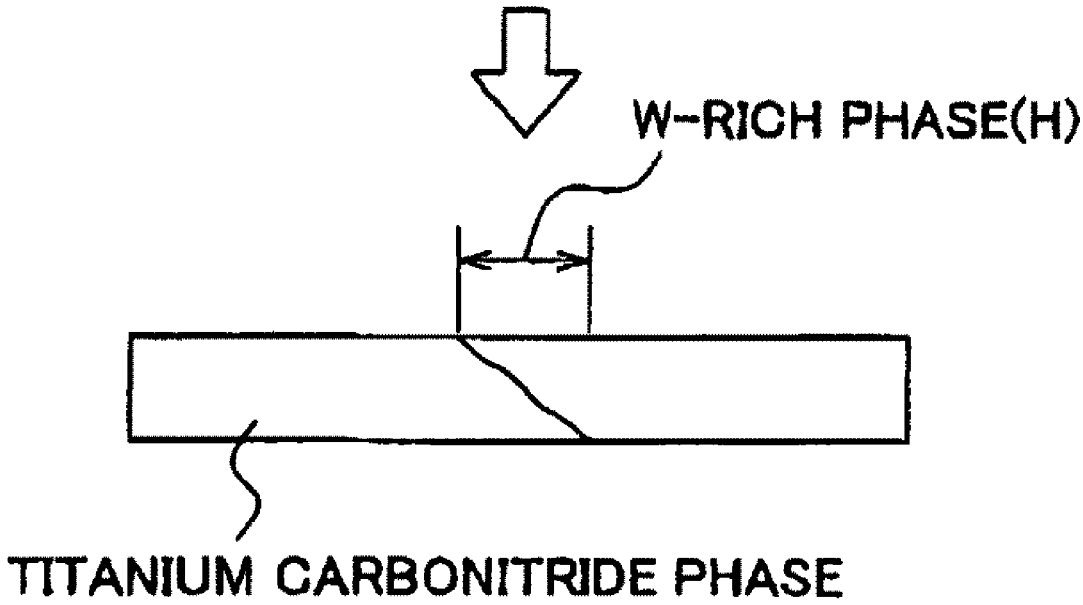
FIG. 4 is an explanatory view schematically showing a longitudinal section of a sample observed by a transmission electron microscope.

Particularly in the present embodiment, as shown in the aforementioned FIG. 2, W-rich phases, in which more W is contained as compared to the surrounding of the W-rich phases, are unevenly distributed in the titanium carbonitride phase. Specifically, according to an observation of the sectional surface of the titanium carbonitride phase (a microstructure observation by a TEM), the W-rich phases are unevenly distributed in a string-like manner and in a mesh-like manner.

Because of the distinctive composition described above, the insert according to the present embodiment is provided with both high wear resistance and breakage resistance, as proved by experiment examples described hereinafter.

Figure 6:
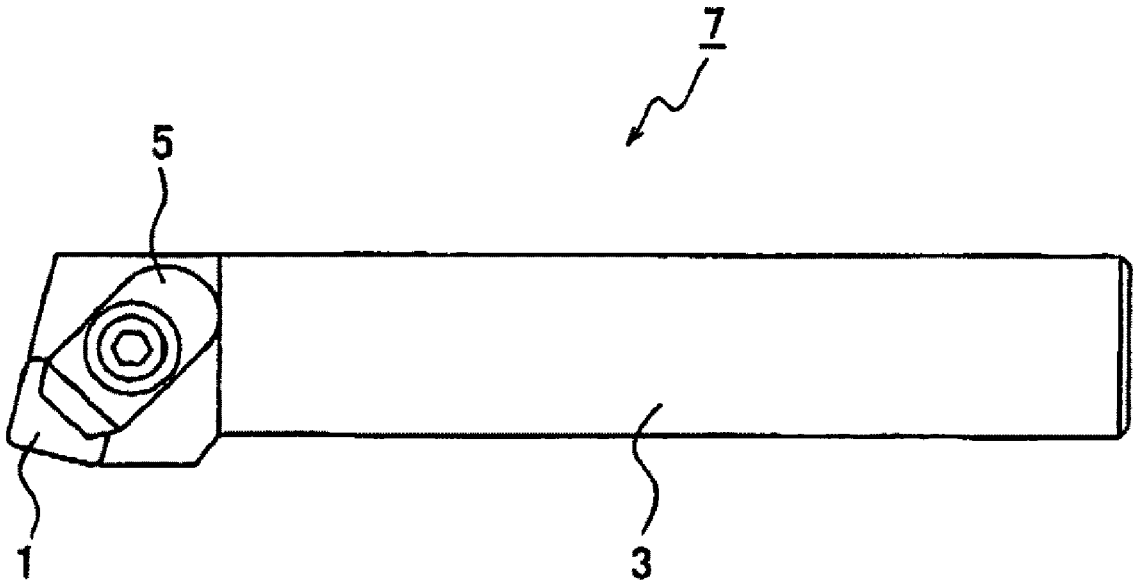
FIG. 6 is an explanatory view showing a cutting tool according to Embodiment 1.

The above-described insert is secured, for example as shown in FIG. 6, to a leading end of a columnar holder 3, made of, for example, steel, by a fixture 5. Cutting of steel and the like is performed by using a cutting tool 7 wherein the insert 1 is secured to the holder 3.

b) The following explains a method for manufacturing the insert according to the present embodiment. In the following, the method for manufacturing inserts used in experiments to be described later is explained as an example.

In the present embodiment, preliminary grinding of TiCN was firstly performed.

Particularly, as raw material powders for the preliminary grinding, powders of $TiCo_{0.5}N_{0.5}$ and powders of $TiC_{0.3}N_{0.7}$ (in the following, the ratios of C/N, such as in $TiC_{0.5}N_{0.5}$, indicate atom ratios) respectively having mean particle sizes ranging from 0.5 to 2 μm are prepared. Both raw material powders were simultaneously grinded in alcohol by a ball mill for 5 hours.

Subsequently, wet mixing was performed by using the above-described TiCN powders preliminarily grinded and other raw material powders.

Particularly, as shown below in FIG. 1, powders of $TiC_{0.5}N_{0.5}$ and powders of $TiC_{0.5}N_{0.7}$ obtained from the preliminary grinding, WC powders having a mean particle size ranging from 1 to 2 μm, Ta powders having a mean particle size ranging from 1 to 2 μm, Mo2C powders having a mean particle size ranging from 2 to 3 μm, NbC powders having a mean particle size ranging from 1 to 2 μm, Co powders having a mean particle size ranging from 2 to 3 μm, and Ni powders having a mean particle size ranging from 2 to 3 μm were prepared. These raw material powders were blended according to the blended compositions shown below in FIG. 1 so as to make 7 types of mixed powders A-G.

TABLE 1

| Composition | Blended composition (mass %) | | | | | | | |
|---|---|---|---|---|---|---|---|---|
| | $TiC_{0.5}N_{0.5}$ | $TiC_{0.3}N_{0.7}$ | WC | TaC | $Mo_2C$ | NbC | Co | Ni |
| A | 40 | 10 | 32 | 4 | 2 | — | 6 | 6 |
| B | 51 | 5 | 15 | — | 10 | 5 | 7 | 7 |
| C | 55 | — | 12 | 10 | 10 | — | 6 | 7 |

TABLE 1-continued

| Composition | Blended composition (mass %) | | | | | | | |
|---|---|---|---|---|---|---|---|---|
| | $TiC_{0.5}N_{0.5}$ | $TiC_{0.3}N_{0.7}$ | WC | TaC | $Mo_2C$ | NbC | Co | Ni |
| D | 35 | 20 | 25 | — | — | 7 | 6 | 7 |
| E | 35 | 15 | 17 | 10 | 5 | — | 8 | 10 |
| F | 25 | 25 | 30 | 5 | — | 5 | 5 | 5 |
| G | 55 | — | 15 | 10 | 10 | — | 5 | 5 |

Subsequently, each of the above-described mixed powders A-G was wet-mixed in alcohol by a ball mill for 24 hours, and then dried.

Subsequently, each type of the dried powders was pressed at pressure of 98 MPa into a shape of a compact.

Figure 7:
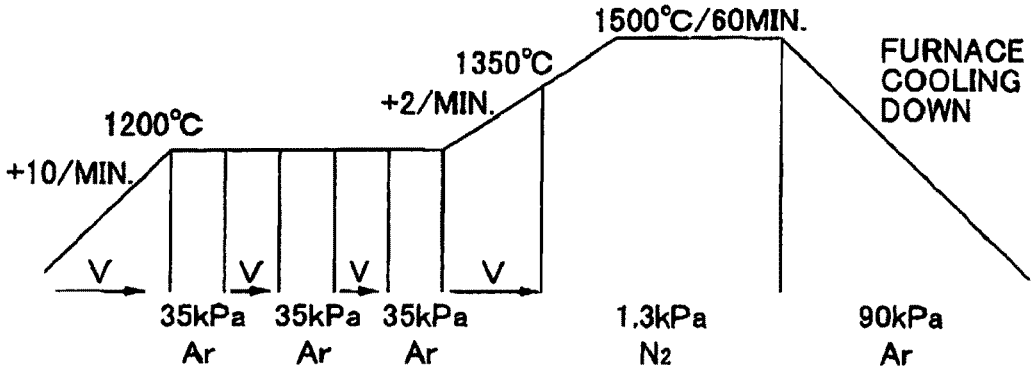
FIG. 7 is an explanatory view describing a manufacturing method of the cermet insert according to Embodiment 1.

Then, each of the compacts was sintered, as shown in FIG. 7, under the following sintering conditions (a)-(e):

(a) from room temperature to 1200° C., temperature was increased at the speed of 10° C./min. in a vacuum atmosphere (V) equal to or smaller than 10 Pa;

(b) once the temperature was increased to 1200° C., an atmosphere alternating process was performed wherein a short Ar atmosphere retention, in which an Ar atmosphere at 35 kPa was retained for 2 minutes, and a short vacuum atmosphere retention, in which a vacuum atmosphere equal to or smaller than 10 Pa was retained for 15 minutes, were alternatively repeated 3 times;

(c) subsequent to the above-described atmosphere alternating process, the temperature was increased up to 1350° C. at the speed of 2° C./min. in a vacuum atmosphere equal to or smaller than 10 Pa;

(d) from 1350° C. to a predetermined sintering temperature (1500° C.), the temperature was increased at the speed of 2° C./min., and the aforementioned sintering temperature was retained for 60 minutes in a nitrogen atmosphere at 1.3 kPa; and (e) a furnace was cooled from the above-described sintering temperature in an Ar atmosphere equal to or smaller than 90 kPa.

Sintering was performed according to the above-described processes (a)-(e). After sintering, grinding was performed so as to produce the insert 1 having a tip shape in compliance with the ISO standard SNGN120408.

In other words, as shown below in Table 3, inserts (Samples No. 1-7) were respectively produced corresponding to the above-described 7 types of mixed powders.

For a comparison purpose, as shown below in Table 3, inserts of comparative examples were also produced. The inserts of comparative examples were made substantially under the same conditions except that the preliminary grinding was not performed (Samples No. 10 and 11), except that the above-described atmosphere alternating process was not performed while the temperature was increased to the sintering temperature (Samples No. 8 and 9), and except that the preliminary grinding and the atmosphere alternating process were not performed (Samples No. 12-14).

c) The following describes the evaluations for cutting performances in regard to the inserts (Samples No. 1-7) according to the present invention, and the inserts (Samples No. 8-14) according to the comparative examples which are made by the above-described manufacturing methods.

As shown below in Table 2, a breakage resistance test and a wear resistance test were performed.

(1) Breakage Resistance Test

Each of the sample inserts was fastened to the leading end portion of a steel shank tool bar (holder) with a screw through a fixture, and a cutting tool was made.

By using the cutting tool, cutting tests were performed, in which dry cutting of alloy steel was intermittently performed at high speed, under the cutting conditions described below in Table 2. In the breakage resistance test, 20 pieces of inserts were used from each type.

A cumulative breakage rate after 700 impacts (the rate in the number of inserts in which breakage was caused by 700 impacts) was checked. The result is shown below in Table 3.

(2) Wear Resistance Test

Each of the sample inserts was fastened to the leading end portion of a steel shank tool bar (holder) with a screw through a fixture, and a cutting tool was made.

By using the cutting tools, cutting tests were performed, in which dry cutting of alloy steel was intermittently performed at high speed, under the cutting conditions described below in Table 2.

The width of flank wear (amount of wear VB) after a 4-minute process was measured. The results are shown in below in Table 3.

(3) Microstructure Observation

By using the sample inserts, TEM observation was performed. Specifically, each of the samples was made so as to have a thickness equal to or smaller than 200 μm. Then, a TEM photograph of each sample was taken by using a TEM (scanning transmission electron microscope), and the photograph was examined.

By the TEM observation, presence/absence of uneven distribution of W was checked. Additionally, by using the above-described STEM, the amount of W contained in the binding phase of each insert was measured. The results are shown below in Table 3.

Figure 8:
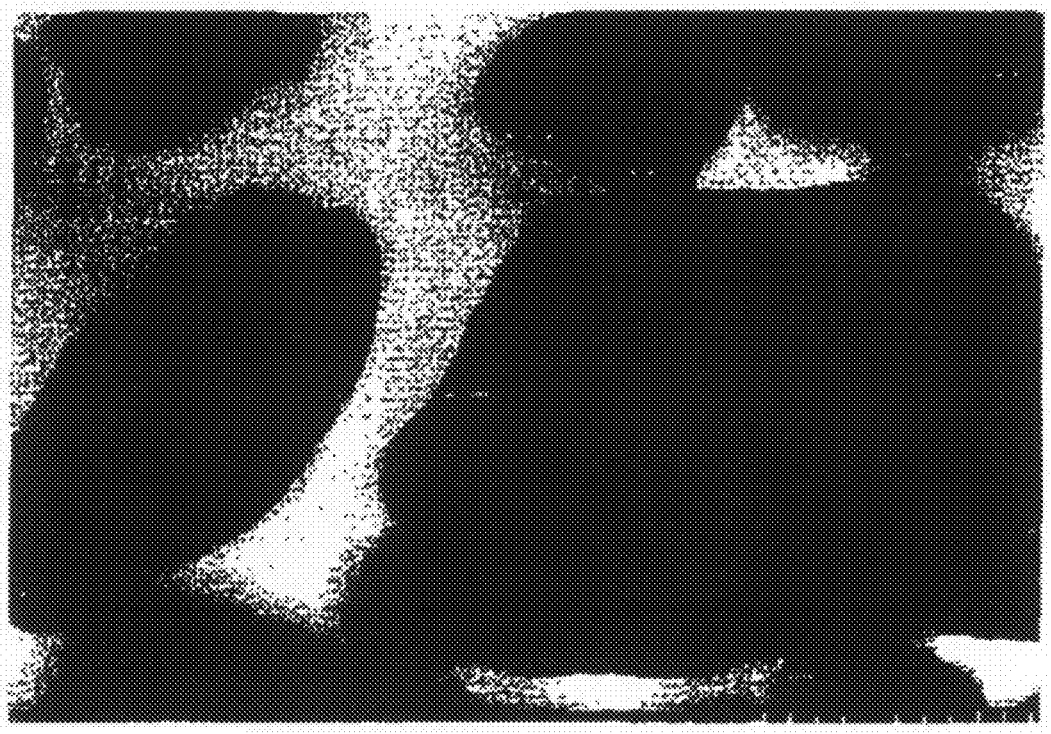
FIG. 8 is a photograph showing a microstructure of a sample according to the present invention observed by the transmission electron microscope.
Figure 9:
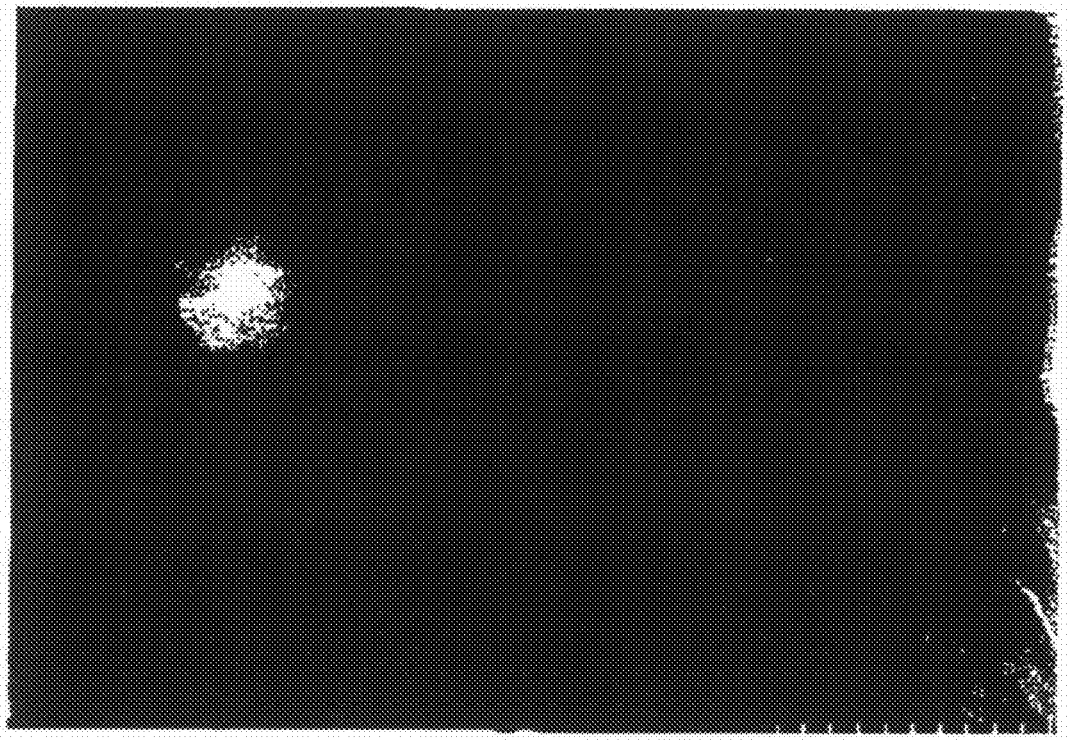
FIG. 9 is a photograph showing a microstructure of a sample according to the present invention observed by the transmission electron microscope.
Figure 10:
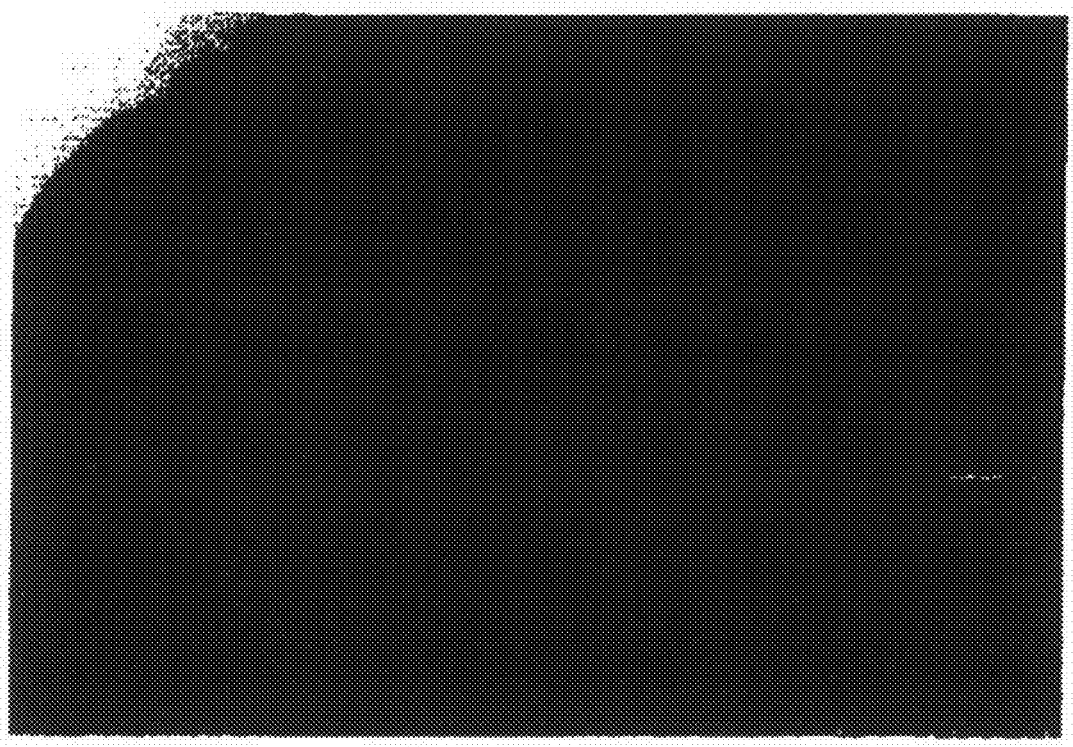
FIG. 10 is a photograph showing a microstructure of a sample according to the present invention observed by the transmission electron microscope.
Figure 11:
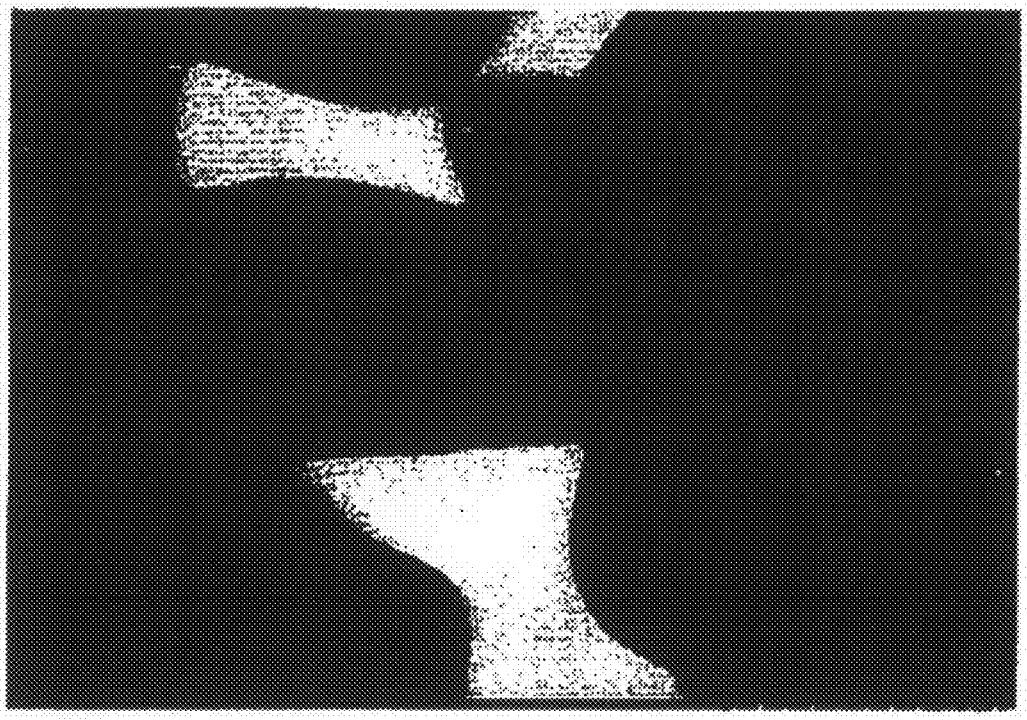
FIG. 11 is a photograph showing a microstructure of a sample according to a comparative example observed by the transmission electron microscope.
Figure 12:
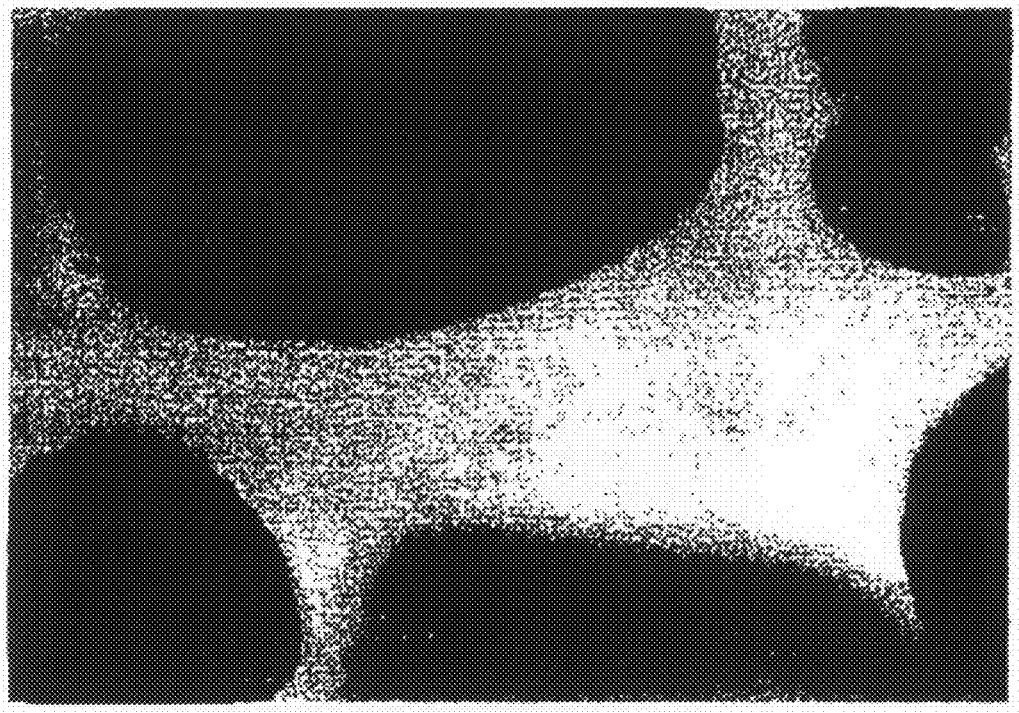
FIG. 12 is a photograph showing a microstructure of a sample according to a comparative example observed by the transmission electron microscope.

Some of the TEM photographs are shown in FIGS. 8-12. FIG. 8 shows a TEM photograph (magnification 100,000) of Sample No. 1 according to the present invention. FIG. 9 shows a TEM photograph (magnification 200,000) of Sample No. 6 according to the present invention. FIG. 10 shows a TEM photograph (magnification 460,000) of Sample No. 4 according to the present invention. FIG. 11 shows a TEM photograph (magnification 100,000) of Sample No. 8 of Comparative Example. FIG. 12 shows a TEM photograph (magnification 200,000) of Sample No. 13 of Comparative Example.

(4) Composition Analysis

According to EDS (Energy Dispersive Spectrometry), the amounts of components (elements), contained in the inserts (Samples No. 1-7) according to the present invention which respectively have Compositions A-G, were assayed. Then, the amounts of the components were converted into the amounts of chemical compounds. The results are shown below in Table 4.

TABLE 2

| Cutting condition | Unit | Breakage resistance test Cumulative breakage rate after 700 impacts | Wear resistance test Amount of wear $V_B$ after 4-min process |
|---|---|---|---|
| Cutting speed | [m/min] | 200 | 300 |
| Feed f | [mm/rev] | 0.25 | 0.15 |
| Depth of cut | [mm] | 1.5 | 1.5 |
| Wet/Dry | | WET | WET |
| Number of impacts | [times] | 700 | — |
| Cutting time | [min] | — | 4 |

TABLE 2-continued

| Cutting condition | Unit | Breakage resistance test Cumulative breakage rate after 700 impacts | Wear resistance test Amount of wear $V_B$ after 4-min process |
|---|---|---|---|
| Tip shape | | SNGN120408 | SNGN120408 |
| Cut material (work) | | SNCM439 (ϕ200 mm round bar: 4 grooves were cut and equally spaced in an axial direction) | SNCM439 (ϕ200 mm round bar) |

Embodiment 2

As raw material powders, powders of $TiC_{0.5}N_{0.6}$, powders of $TiC_{0.3}N_{0.7}$, powders of $TiC_{0.15}N_{0.85}$ (the ratios of C/N, such as in $TiC_{0.5}N_{0.6}$, indicate atom ratios), powders of NbC, powders of TaC, powders of WC, powders of Co, and powders of Ni respectively having mean particle sizes ranging from 0.5 to 2 μm were prepared. These raw material powders were combined according to the blended compositions shown in Table 5, wet-mixed by a ball mill for 24 hours, and dried. Subsequently, each type of the dried powders was pressed at pressure of 98 MPa into a shape of a compact. Each of the compacts was sintered under the following conditions:

(a) from room temperature to 1280° C., temperature was increased at the speed of 2° C./min. in a vacuum atmosphere equal to or smaller than 10 Pa;

TABLE 3

| | Sample No. | Composition | Preliminary grinding | Ar alternating atmosphere process | Uneven distribution of W | Amount of W in binding phase [mass %] | Cutting evaluation Cumulative breakage rate [%] | Cutting evaluation Amount of wear $V_B$ [mm] |
|---|---|---|---|---|---|---|---|---|
| Present invention | 1 | A | Present | Present | Present | 32 | 35 | 0.11 |
| | 2 | B | Present | Present | Present | 28 | 40 | 0.11 |
| | 3 | C | Present | Present | Present | 25 | 40 | 0.1 |
| | 4 | D | Present | Present | Present | 50 | 20 | 0.08 |
| | 5 | E | Present | Present | Present | 30 | 25 | 0.12 |
| | 6 | F | Present | Present | Present | 59 | 25 | 0.07 |
| | 7 | G | Present | Present | Present | 26 | 45 | 0.1 |
| Comparative examples | 8 | A | Present | Absent | Absent | 21 | 70 | 0.15 |
| | 9 | B | Present | Absent | Absent | 14 | 70 | 0.14 |
| | 10 | C | Absent | Present | Absent | 23 | 60 | 0.13 |
| | 11 | D | Absent | Present | Absent | 51 | 50 | 0.10 |
| | 12 | E | Absent | Absent | Absent | 11 | 65 | 0.16 |
| | 13 | F | Absent | Absent | Absent | 38 | 55 | 0.13 |
| | 14 | G | Absent | Absent | Absent | 9 | 85 | 0.13 |

TABLE 4

| Composition | Insert (sintered body) composition [mass %] TiCN | WC | TaC | $Mo_2C$ | NbC | Co | Ni |
|---|---|---|---|---|---|---|---|
| A | 51 | 35 | 3 | 2 | — | 5 | 5 |
| B | 58 | 18 | — | 8 | 4 | 6 | 6 |
| C | 57 | 16 | 8 | 9 | — | 5 | 6 |
| D | 56 | 28 | — | — | 6 | 5 | 6 |
| E | 53 | 19 | 8 | 4 | — | 7 | 9 |
| F | 51 | 33 | 4 | — | 4 | 4 | 4 |
| G | 57 | 18 | 9 | 8 | — | 4 | 4 |

The results, shown in the aforementioned Tables 1-4, indicate that the inserts according to the present invention have a remarkable effect wherein high wear resistance and high breakage resistance can be both achieved by W-rich phases, in which more W is contained as compared to the surrounding of the W-rich phases, being unevenly distributed particularly in the titanium carbonitride phases of the hard phases, as shown in, for example, aforementioned FIGS. 8-10. In FIGS. 8-10, white lines showing string-like or mesh-like W-rich phases can be observed. In FIG. 9, a white spot showing layered W-rich phases can be observed.

On the other hand, the inserts of Comparative Examples are not desirable, since high wear resistance and high breakage resistance do not exist together in the inserts of Comparative Examples, although the wear resistance thereof is good to some extent.

(b) once the temperature was increased to 1280° C., an atmosphere alternating process was performed wherein a short Ar atmosphere retention, in which an Ar atmosphere at 35 kPa was retained for 2 minutes, and a short vacuum atmosphere, in which a vacuum atmosphere equal to or smaller than 10 Pa was retained for 10 minutes, were alternatively repeated the number of times shown in Table 5;

(c) subsequent to the above-described atmosphere alternating process, the temperature was increased up to 1420° C. at the speed of 2° C./min. in a vacuum atmosphere equal to or smaller than 10 Pa;

(d) from 1420° C. to a predetermined sintering temperature in the range of 1480-1560° C., the temperature was increased at the speed of 2° C./min., and the aforementioned sintering temperature was retained for 1.5 hours in a nitrogen atmosphere at 1300 Pa; and (e) a furnace was cooled from the above-described sintering temperature in a vacuum atmosphere equal to or smaller than 10 Pa.

Sintering was performed according to the above-described processes (a)-(e). After sintering, honing (R: 0.07 mm) was performed to cutting edges so as to produce the inserts 1-10 according to the present embodiment which respectively have tip shapes in compliance with the ISO standard CNMG120412.

For a comparison purpose, as shown below in Table 6, conventional inserts 1-10 were also produced. The conventional inserts 1-10 were made substantially under the same conditions except that the above-described atmosphere altering process was not performed while the temperature was increased to the sintering temperature.

With respect to the inserts 1-10 according to the present embodiment and the conventional inserts 1-10 obtained as a result of the above-described production, microstructure observation of TiCN-based cermets constituting the aforementioned inserts was performed by a scanning electron microscope, and analysis of binding phases was performed. The results are respectively shown in Tables 7 and 8.

Subsequently, each of the above-described inserts 1-10 according to the present embodiment and the conventional inserts 1-10 was fastened to a leading end portion of a steel shank tool bar with a screw through a fixture. Then, following tests were performed in the above-described state under the conditions described below.

One type of cutting tests was performed, in which dry cutting of alloy steel was intermittently performed at high speed (normal cutting speed in a cutting process of alloy steel is 200 m/min) under the following conditions (to be referred to as Cutting condition A):

Cut material: a round bar in compliance with JIS-SCM440 having 4 longitudinal grooves spaced evenly in the length direction, Cutting speed: 300 m/min, Depth of cut: 1.5 mm, Feed: 0.2 mm/rev, and Cutting time: 10 minutes.

Another type of cutting tests was performed, in which dry cutting of carbon steel was intermittently performed at high speed (normal cutting speed in a cutting process of carbon steel is 250 m/min) under the following conditions (to be referred to as Cutting condition B):

Cut material: a round bar in compliance with JIS-S20C,

Cutting speed: 350 m/min,

Depth of cut: 1.0 mm,

Feed: 0.2 mm/rev, and

Cutting time: 20 minutes.

Still another type of cutting tests was performed, in which dry cutting of cast iron was intermittently performed at high speed (normal cutting speed in a cutting process of cast iron is 280 m/min) under the following conditions (to be referred to as Cutting condition C):

Cut material: a round bar in compliance with JIS-FC300,

Cutting speed: 400 m/min,

Depth of cut: 2.5 mm,

Feed: 0.3 mm/rev, and

Cutting time: 20 minutes.

In all types of cutting tests, the widths of flank wear of the cutting edges were measured. The measurement results are shown in Table 9.

TABLE 5

| Type | | Blended composition (mass %) | | | | | | | | Atmosphere alternating process while temperature is increasing | |
|---|---|---|---|---|---|---|---|---|---|---|---|
| | | $TiC_{0.5}N_{0.5}$ | $TiC_{0.3}N_{0.7}$ | $TiC_{0.15}N_{0.85}$ | WC | TaC | NbC | Co | Ni | Number of short Ar atmosphere retention | Number of short vaccum atmosphere retention |
| Inserts of present embodiment | 1 | 25 | 25 | — | 20 | 10 | — | 10 | 10 | 2 | 2 |
| | 2 | — | 25 | 25 | 25 | — | 5 | 10 | 10 | 2 | 3 |
| | 3 | 35 | — | 15 | 30 | 5 | 5 | 5 | 5 | 3 | 2 |
| | 4 | 35 | 20 | — | 25 | — | 7 | 6 | 7 | 3 | 3 |
| | 5 | — | 45 | 10 | 25 | 10 | — | 5 | 5 | 3 | 4 |
| | 6 | 15 | — | 40 | 30 | 1 | 4 | 5 | 5 | 4 | 3 |
| | 7 | 10 | 50 | — | 20 | 5 | — | 6 | 9 | 4 | 4 |
| | 8 | — | 30 | 30 | 20 | 4 | 3 | 8 | 5 | 5 | 4 |
| | 9 | 40 | — | 20 | 25 | — | 5 | 5 | 5 | 5 | 5 |
| | 10 | 20 | 20 | 20 | 20 | — | 7 | 6 | 7 | 6 | 6 |

TABLE 6

| Type | | Blended composition (mass %) | | | | | | | | Atmosphere alternating process while temperature is increasing | |
|---|---|---|---|---|---|---|---|---|---|---|---|
| | | $TiC_{0.5}N_{0.5}$ | $TiC_{0.3}N_{0.7}$ | $TiC_{0.15}N_{0.85}$ | WC | TaC | NbC | Co | Ni | Number of short Ar atmosphere retention | Number of short vaccum atmosphere retention |
| Conventional inserts | 1 | 50 | — | — | 20 | 10 | — | 10 | 10 | — | — |
| | 2 | 50 | — | — | 25 | — | 5 | 10 | 10 | — | — |
| | 3 | 50 | — | — | 30 | 5 | 5 | 5 | 5 | — | — |
| | 4 | 55 | — | — | 25 | — | 7 | 6 | 7 | — | — |
| | 5 | 55 | — | — | 25 | 10 | — | 5 | 5 | — | — |
| | 6 | 55 | — | — | 30 | 1 | 4 | 5 | 5 | — | — |
| | 7 | 60 | — | — | 20 | 5 | — | 6 | 9 | — | — |
| | 8 | 60 | — | — | 20 | 4 | 3 | 8 | 5 | — | — |
| | 9 | 60 | — | — | 25 | — | 5 | 5 | 5 | — | — |
| | 10 | 60 | — | — | 20 | — | 7 | 6 | 7 | — | — |

TABLE 7

| Type | | TiCN-based cermet | | | | | | | |
|---|---|---|---|---|---|---|---|---|---|
| | | Microstructure (area %) | | Component composition of binding phase (mass %) | | | | | |
| | | Hard phase | Binding phase | Co | Ni | Ti | Ta | Nb | W + impurities |
| Cutting tip of present invention | 1 | 75.1 | remainder | 29.0 | 29.5 | 0.6 | 0.5 | — | remainder (cont. W: 40.2%) |
| | 2 | 78.7 | remainder | 28.5 | 29.4 | 0.6 | — | 0.4 | remainder (cont. W: 40.9%) |
| | 3 | 84.9 | remainder | 18.1 | 20.0 | 1.0 | 0.6 | 0.4 | remainder (cont. W: 59.8%) |
| | 4 | 84.7 | remainder | 21.7 | 25.2 | 1.1 | — | 0.9 | remainder (cont. W: 51.0%) |
| | 5 | 89.8 | remainder | 27.5 | 27.9 | 2.0 | 0.8 | — | remainder (cont. W: 41.7%) |
| | 6 | 86.7 | remainder | 19.8 | 20.1 | 1.9 | 0.5 | 0.8 | remainder (cont. W: 56.6%) |
| | 7 | 85.0 | remainder | 22.0 | 34.8 | 2.0 | 0.9 | — | remainder (cont. W: 40.1%) |
| | 8 | 86.6 | remainder | 32.9 | 20.5 | 2.5 | 0.7 | 0.8 | remainder (cont. W: 42.5%) |
| | 9 | 88.4 | remainder | 22.4 | 22.5 | 2.7 | — | 1.4 | remainder (cont. W: 50.7%) |
| | 10 | 86.7 | remainder | 27.4 | 23.5 | 3.0 | — | 1.9 | remainder (cont. W: 43.9%) |

TABLE 8

| Type | | TiCN-based cermet | | | | | | | |
|---|---|---|---|---|---|---|---|---|---|
| | | Microstructure (area %) | | Component composition of binding phase (mass %) | | | | | |
| | | Hard phase | Binding phase | W | Ti | Ta | Nb | Ni | Co + impurities |
| Conventional inserts | 1 | 83.1 | remainder | 1.1 | 0.5 | 0.6 | — | 49.0 | remainder (cont. Co: 48.7%) |
| | 2 | 84.2 | remainder | 2.3 | 0.6 | — | 0.3 | 48.2 | remainder (cont. Co: 48.3%) |
| | 3 | 91.5 | remainder | 8.4 | 1.1 | 0.5 | 0.5 | 44.5 | remainder (cont. Co: 44.6%) |
| | 4 | 90.0 | remainder | 3.4 | 1.0 | — | 0.9 | 51.0 | remainder (cont. Co: 43.5%) |
| | 5 | 91.8 | remainder | 9.9 | 2.2 | 1.0 | — | 43.6 | remainder (cont. Co: 43.2%) |
| | 6 | 91.9 | remainder | 8.3 | 2.0 | 0.4 | 0.7 | 44.4 | remainder (cont. Co: 44.1%) |
| | 7 | 88.8 | remainder | 2.5 | 1.9 | 0.9 | — | 59.9 | remainder (cont. Co: 34.5%) |
| | 8 | 90.1 | remainder | 6.5 | 2.1 | 0.5 | 1.1 | 35.0 | remainder (cont. Co: 54.6%) |
| | 9 | 92.8 | remainder | 4.3 | 2.5 | — | 1.7 | 45.8 | remainder (cont. Co: 45.5%) |
| | 10 | 90.1 | remainder | 9.2 | 3.1 | — | 1.9 | 46.2 | remainder (cont. Co: 39.5%) |

TABLE 9

| Type | | Widths of flank wear (mm) | | | Type | | Widths of flank wear (mm) | | |
|---|---|---|---|---|---|---|---|---|---|
| | | Cutting condition A | Cutting condition B | Cutting condition C | | | Cutting condition A | Cutting condition B | Cutting condition C |
| Inserts of present embodiment | 1 | 0.11 | 0.16 | 0.25 | Conventional inserts | 1 | 0.38 | 0.37 | 0.47 |
| | 2 | 0.15 | 0.18 | 0.20 | | 2 | 0.37 | 0.36 | 0.47 |
| | 3 | 0.13 | 0.17 | 0.25 | | 3 | 0.38 | 0.39 | 0.49 |
| | 4 | 0.15 | 0.15 | 0.24 | | 4 | 0.36 | 0.38 | 0.48 |
| | 5 | 0.13 | 0.19 | 0.21 | | 5 | 0.37 | 0.38 | 0.46 |

TABLE 9-continued

| Type | Widths of flank wear (mm) | | | Type | Widths of flank wear (mm) | | |
|---|---|---|---|---|---|---|---|
| | Cutting condition A | Cutting condition B | Cutting condition C | | Cutting condition A | Cutting condition B | Cutting condition C |
| 6 | 0.12 | 0.17 | 0.21 | 6 | 0.40 | 0.37 | 0.45 |
| 7 | 0.12 | 0.16 | 0.20 | 7 | 0.36 | 0.42 | 0.49 |
| 8 | 0.10 | 0.19 | 0.21 | 8 | 0.37 | 0.39 | 0.51 |
| 9 | 0.14 | 0.16 | 0.22 | 9 | 0.39 | 0.41 | 0.45 |
| 10 | 0.13 | 0.17 | 0.24 | 10 | 0.34 | 0.41 | 0.49 |

The results, shown in Tables 5-9, indicate that the inserts 1-10 according to the present embodiment exhibit excellent wear resistance, even in a high-speed cutting process which involves generation of high heat. This is because the binding phases of the TiCN-based cermets, which are common components in the inserts 1-10 according to the present embodiment, gain an excellent degree of high-temperature hardness, due to high percentages (40-60%) of W components contained therein. On the other hand, in the conventional inserts 1-10, the percentages of W contained in the binding phases are low (1-10%). Therefore, a good degree of high-temperature hardness cannot be expected in the binding phases, and progress of wear in the above-described binding phases is facilitated, particularly in a high-speed cutting process. This apparently causes the usage-life of the conventional inserts to end relatively in a short period of time.

As described above, the inserts according to the present embodiment exhibit excellent wear resistance, not only in a cutting process for cutting various types of steel, cast iron, and so on under normal conditions, but also in a high-speed cutting process which involves generation of high heat. As a result, the inserts according to the present embodiment can be fully satisfied in terms of saving power, energy, and cost in cutting processes.

Embodiment 3

As raw material powders, powders of $TiC_{0.5}N_{0.5}$, powders of $TiC_{0.3}N_{0.7}$, powders of $TiC_{0.15}N_{0.85}$ (the ratios of C/N, such as in $TiC_{0.5}N_{0.5}$, indicate atom ratios), powders of WC, powders of TaC, powders of NbC, powders of ZrC, powders of VC, powders of $Mo_2C$, powders of Co, and powders of Ni respectively having mean particle sizes ranging from 0.5 to 2 μm were prepared. These raw material powders were combined according to the blended compositions shown in Table 10, wet-mixed by a ball mill for 24 hours, and dried. Subsequently, each type of the dried powders was pressed at pressure of 98 MPa into a shape of a compact. Each of the compacts was sintered under the following conditions:

(a) from room temperature to 1280° C., temperature was increased at the speed of 2° C./min. in a vacuum atmosphere equal to or smaller than 10 Pa;

(b) once the temperature was increased to 1280° C., an atmosphere alternating process was performed wherein a short Ar atmosphere retention, in which an Ar atmosphere at 35 kPa was retained for 2 minutes, and a short vacuum atmosphere, in which a vacuum atmosphere equal to or smaller than 10 Pa was retained for 10 minutes, were alternatively repeated the number of times shown in Table 10;

(c) subsequent to the above-described atmosphere alternating process, temperature was increased up to 1420° C. at the speed of 2° C./min. in a vacuum atmosphere equal to or smaller than 10 Pa;

(d) from 1420° C. to a predetermined sintering temperature in the range of 1480-1560° C., the temperature was increased at the speed of 2° C./min., and the aforementioned sintering temperature was retained for 1.5 hours in a nitrogen atmosphere at 1300 Pa; and (e) a furnace was cooled from the above-described sintering temperature in a vacuum atmosphere equal to or smaller than 10 Pa.

Sintering was performed according to the above-described processes (a)-(e). After sintering, honing (R: 0.07 mm) was performed to cutting edges so as to produce the inserts 1-15 according to the present embodiment which respectively have tip shapes in compliance with the ISO standard CNMG120412.

For a comparison purpose, as shown below in Table 11, conventional inserts 1-15 were also produced. The conventional inserts 1-15 were made substantially under the same conditions except that only the above-described powders of $TiC_{0.5}N_{0.5}$ was used among the raw material powders made of TiCN, and that the above-described atmosphere altering process was not performed while the temperature was increased to the sintering temperature.

With respect to the inserts 1-15 according to the present embodiment and the conventional inserts 1-15 obtained as a result of the above-described production, microstructure observation of TiCN-based cermets constituting the aforementioned inserts was performed by a scanning electron microscope, and analysis of binding phases was performed. The results are respectively shown in Tables 12, 13.

Figure 13:
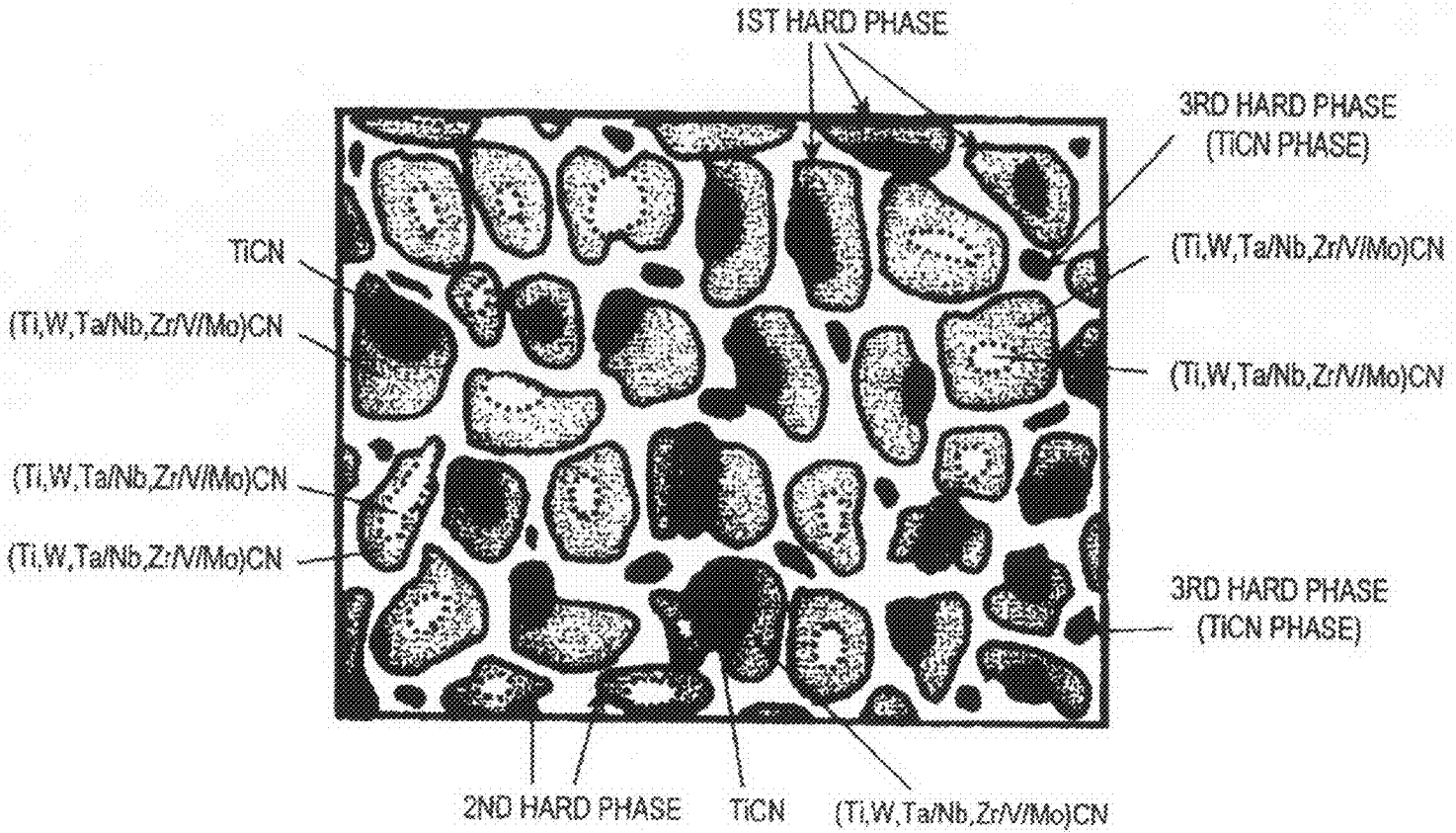
FIG. 13 is an explanatory view schematically showing a longitudinal section of a sample according to Embodiment 3 observed by a transmission electron microscope.

FIG. 13 schematically shows the result of the microstructure observation of the cermet according to the present embodiment by a scanning electron microscope (magnification 10,000).

Subsequently, each of the above-described inserts 1-15 according to the present embodiment and the conventional inserts 1-15 was fastened to a leading end portion of a steel shank tool bar with a screw through a fixture. Then, following tests were performed in the above-described state under the conditions described below.

One type of cutting tests was performed, in which dry cutting of carbon steel was intermittently performed at high speed (normal cutting speed in a cutting process of carbon steel is 250 m/min) under the following conditions (to be referred to as Cutting condition A): Cut material: a round bar in compliance with JIS-S20C having 4 longitudinal grooves spaced evenly in the length direction, Cutting speed: 380 m/min, Depth of cut: 1.5 mm, Feed: 0.2 mm/rev, and Cutting time: 10 minutes.

Another type of cutting tests was performed, in which dry cutting of alloy steel was intermittently performed at high speed (normal cutting speed in a cutting process of alloy steel is 200 m/min) under the following conditions (to be referred to as Cutting condition B):

Cut material: a round bar in compliance with JIS-SCM440,
Cutting speed: 300 m/min,
Depth of cut: 1 mm,
Feed: 0.2 mm/rev, and
Cutting time: 20 minutes.

Still another type of cutting tests was performed, in which dry cutting of cast iron was intermittently performed at high speed (normal cutting speed in a cutting process of cast iron is 280 m/min) under the following conditions (to be referred to as Cutting condition C):

Cut material: a round bar in compliance with JIS-FC300,
Cutting speed: 380 m/min,
Depth of cut: 2.5 mm,
Feed: 0.3 mm/rev, and
Cutting time: 20 minutes.

In all types of cutting tests, the widths of flank wear of the cutting edges were measured. The measurement results are shown in Table 14.

TABLE 10

| | | Blended composition (mass %) | | | | | | | | | | | Atmosphere alternating process while temperature is increasing | |
|---|---|---|---|---|---|---|---|---|---|---|---|---|---|---|
| Type | | $TiC_{0.5}N_{0.5}$ | $TiC_{0.3}N_{0.7}$ | $TiC_{0.15}N_{0.85}$ | WC | TaC | NbC | ZrC | VC | $Mo_2C$ | Co | Ni | Number of short Ar atmosphere retention | Number of short vacuum atmosphere retention |
| Inserts of present embodiment | 1 | 20 | 33 | — | 20 | — | 5 | — | 2 | — | 10 | 10 | 2 | 2 |
| | 2 | 25 | — | 25 | 22 | 6 | — | 1 | — | 1 | 10 | 10 | 2 | 2 |
| | 3 | — | 35 | 15 | 25 | 5 | 2 | 3 | — | — | 7 | 8 | 3 | 2 |
| | 4 | 17 | 17 | 17 | 28 | — | 6 | — | — | 2 | 6 | 7 | 3 | 2 |
| | 5 | 10 | — | 42 | 30 | 5 | — | 1 | 1 | 1 | 5 | 5 | 3 | 3 |
| | 6 | 35 | 21 | — | 20 | 3 | 3 | — | 2 | 1 | 7 | 8 | 3 | 3 |
| | 7 | 40 | — | 14 | 22 | — | 7 | 2 | — | — | 9 | 6 | 4 | 3 |
| | 8 | — | 20 | 35 | 25 | 6 | — | — | 1 | 2 | 5 | 6 | 4 | 3 |
| | 9 | 10 | 34 | 10 | 28 | — | 5 | 1 | 1 | 1 | 5 | 5 | 4 | 4 |
| | 10 | 28 | 28 | — | 28 | — | 5 | — | 1 | — | 5 | 5 | 4 | 4 |
| | 11 | 15 | 42 | — | 20 | 7 | — | — | — | 3 | 5 | 8 | 5 | 4 |
| | 12 | 20 | 20 | 20 | 22 | 1 | 4 | — | 3 | — | 5 | 5 | 5 | 5 |
| | 13 | 28 | — | 30 | 24 | — | 5 | 1 | 1 | 1 | 5 | 5 | 5 | 5 |
| | 14 | — | 10 | 49 | 21 | 5 | — | 5 | — | — | 5 | 5 | 6 | 5 |
| | 15 | — | 13 | 45 | 20 | 4 | 3 | — | 4 | 1 | 5 | 5 | 6 | 6 |

TABLE 11

| | | Blended composition (mass %) | | | | | | | | | | | Atmosphere alternating process while temperature is increasing | |
|---|---|---|---|---|---|---|---|---|---|---|---|---|---|---|
| Type | | $TiC_{0.5}N_{0.5}$ | $TiC_{0.3}N_{0.7}$ | $TiC_{0.15}N_{0.85}$ | WC | TaC | NbC | ZrC | VC | $Mo_2C$ | Co | Ni | Number of short Ar atmosphere retention | Number of short vacuum atmosphere retention |
| Conventional inserts | 1 | 53 | — | — | 20 | — | 5 | — | 2 | — | 10 | 10 | — | — |
| | 2 | 50 | — | — | 22 | 6 | — | 1 | — | 1 | 10 | 10 | — | — |
| | 3 | 50 | — | — | 25 | 5 | 2 | 3 | — | — | 7 | 8 | — | — |
| | 4 | 51 | — | — | 28 | — | 6 | — | — | 2 | 6 | 7 | — | — |
| | 5 | 52 | — | — | 30 | 5 | — | 1 | 1 | 1 | 5 | 5 | — | — |
| | 6 | 56 | — | — | 20 | 3 | 3 | — | 2 | 1 | 7 | 8 | — | — |
| | 7 | 54 | — | — | 22 | — | 7 | 2 | — | — | 9 | 6 | — | — |
| | 8 | 55 | — | — | 25 | 6 | — | — | 1 | 2 | 5 | 6 | — | — |
| | 9 | 54 | — | — | 28 | — | 5 | 1 | 1 | 1 | 5 | 5 | — | — |
| | 10 | 56 | — | — | 28 | — | 5 | — | 1 | — | 5 | 5 | — | — |
| | 11 | 57 | — | — | 20 | 7 | — | — | — | 3 | 5 | 8 | — | — |
| | 12 | 60 | — | — | 22 | 1 | 4 | — | 3 | — | 5 | 5 | — | — |
| | 13 | 58 | — | — | 24 | — | 5 | 1 | 1 | 1 | 5 | 5 | — | — |
| | 14 | 59 | — | — | 21 | 5 | — | 5 | — | — | 5 | 5 | — | — |
| | 15 | 58 | — | — | 20 | 4 | 3 | — | 4 | 1 | 5 | 5 | — | — |

TABLE 12

| | | TiCN-based cermet | | | | | | | | | | |
|---|---|---|---|---|---|---|---|---|---|---|---|---|
| | | Microstructure (area %) | | Component composition of binding phase (mass %) | | | | | | | | |
| Type | | Hard phase | Binding phase | Co | Ni | Ti | Ta | Nb | Zr | V | Mo | W + impurities |
| Inserts of present embodiment | 1 | 79.6 | remainder | 28.6 | 28.6 | 1.1 | — | 0.6 | — | 0.4 | — | remainder (cont. W: 40.5%) |
| | 2 | 75.2 | remainder | 27.0 | 27.3 | 1.0 | 0.6 | — | 0.2 | — | 0.2 | remainder (cont. W: 43.5%) |
| | 3 | 80.5 | remainder | 20.2 | 23.2 | 0.6 | 0.4 | 0.3 | 0.5 | — | — | remainder (cont W: 54.5%) |
| | 4 | 81.1 | remainder | 18.1 | 20.2 | 1.0 | — | 0.5 | — | — | 0.2 | remainder (cont. W: 59.8%) |
| | 5 | 88.2 | remainder | 24.6 | 24.9 | 1.8 | 0.8 | — | 0.4 | 0.6 | 0.3 | remainder (cont. W: 46.5%) |
| | 6 | 83.5 | remainder | 22.9 | 26.1 | 1.5 | 0.8 | 1.1 | — | 0.9 | 0.5 | remainder (cont. W: 46.0%) |
| | 7 | 84.4 | remainder | 32.9 | 22.8 | 1.1 | — | 0.7 | 0.2 | — | — | remainder (cont. W: 42.0%) |
| | 8 | 85.6 | remainder | 18.5 | 22.4 | 0.6 | 1.1 | — | — | 0.2 | 0.3 | remainder (cont. W: 56.6%) |
| | 9 | 89.4 | remainder | 27.2 | 27.6 | 1.2 | — | 1.6 | 0.3 | 0.3 | 0.2 | remainder (cont. W: 41.2%) |
| | 10 | 89.5 | remainder | 27.9 | 27.6 | 1.0 | — | 1.3 | — | 0.5 | — | remainder (cont. W: 41.6%) |
| | 11 | 86.5 | remainder | 21.9 | 34.9 | 0.7 | 0.7 | — | — | — | 0.5 | remainder (cont. W: 41.1%) |
| | 12 | 92.9 | remainder | 27.6 | 27.4 | 1.8 | 0.5 | 1.3 | — | 1.0 | — | remainder (cont. W: 40.1%) |
| | 13 | 88.4 | remainder | 22.1 | 22.6 | 1.5 | — | 1.6 | 0.6 | 0.5 | 0.6 | remainder (cont. W: 50.3%) |
| | 14 | 87.4 | remainder | 20.3 | 20.7 | 0.6 | 0.6 | — | 0.4 | — | — | remainder (cont. W: 57.3%) |
| | 15 | 87.8 | remainder | 20.6 | 20.5 | 1.9 | 1.3 | 0.9 | — | 0.5 | 0.2 | remainder (cont. W: 53.9%) |

TABLE 13

| | | TiCN-based cermet | | | | | | | | | | |
|---|---|---|---|---|---|---|---|---|---|---|---|---|
| | | Microstructure (area %) | | Component composition of binding phase (mass %) | | | | | | | | |
| Type | | Hard phase | Binding phase | W | Ti | Ta | Nb | Zr | V | Mo | Ni | W + impurities |
| Conventional inserts | 1 | 84.6 | remainder | 4.2 | 1.0 | — | 0.5 | — | 0.3 | — | 46.8 | remainder (cont. Co: 47.0%) |
| | 2 | 84.0 | remainder | 1.8 | 1.2 | 0.4 | — | 0.2 | — | 0.2 | 48.1 | remainder (cont. Co: 47.8%) |
| | 3 | 88.0 | remainder | 1.9 | 0.9 | 0.4 | 0.3 | 0.3 | — | — | 51.3 | remainder (cont. Co: 44.6%) |
| | 4 | 89.4 | remainder | 6.0 | 0.9 | — | 0.5 | — | — | 0.5 | 49.2 | remainder (cont. Co: 42.5%) |
| | 5 | 91.9 | remainder | 2.1 | 1.6 | 0.9 | — | 0.6 | 0.4 | 0.3 | 46.7 | remainder (cont. Co: 47.1%) |
| | 6 | 88.3 | remainder | 7.9 | 1.3 | 0.8 | 1.0 | — | 1.1 | 0.8 | 46.3 | remainder (cont. Co: 40.5%) |
| | 7 | 88.5 | remainder | 4.1 | 1.0 | — | 0.6 | 0.4 | — | — | 35.2 | remainder (cont. Co: 58.5%) |
| | 8 | 91.3 | remainder | 3.4 | 1.1 | 0.9 | — | — | 0.2 | 0.2 | 51.7 | remainder (cont. Co: 42.4%) |
| | 9 | 91.9 | remainder | 9.9 | 1.2 | — | 1.7 | 0.3 | 0.2 | 0.4 | 43.1 | remainder (cont. Co: 43.0%) |
| | 10 | 92.2 | remainder | 4.3 | 0.9 | — | 1.1 | — | 1.0 | — | 46.3 | remainder (cont. Co: 46.2%) |
| | 11 | 89.8 | remainder | 6.8 | 0.8 | 0.7 | — | — | — | 0.6 | 59.9 | remainder (cont. Co: 31.1%) |
| | 12 | 92.7 | remainder | 1.4 | 1.5 | 0.7 | 1.6 | — | 1.2 | — | 46.6 | remainder (cont. Co: 46.7%) |
| | 13 | 92.3 | remainder | 6.9 | 1.6 | — | 1.4 | 0.7 | 0.6 | 0.7 | 44.2 | remainder (cont. Co: 43.8%) |

TABLE 13-continued

| Type | | TiCN-based cermet | | | | | | | | | | |
|---|---|---|---|---|---|---|---|---|---|---|---|---|
| | | Microstructure (area %) | | Component composition of binding phase (mass %) | | | | | | | | |
| | | Hard phase | Binding phase | W | Ti | Ta | Nb | Zr | V | Mo | Ni | W + impurities |
| | 14 | 92.4 | remainder | 4.4 | 0.6 | 0.8 | — | 0.6 | — | — | 46.8 | remainder (cont. Co: 46.5%) |
| | 15 | 92.3 | remainder | 8.9 | 1.7 | 1.2 | 1.0 | — | 1.1 | 0.2 | 43.1 | remainder (cont. Co: 42.6%) |

TABLE 14

| Type | | Widths of flank wear (mm) | | | Type | | Widths of flank wear (mm) | | |
|---|---|---|---|---|---|---|---|---|---|
| | | Cutting condition A | Cutting condition B | Cutting condition C | | | Cutting condition A | Cutting condition B | Cutting condition C |
| Inserts of present embodiment | 1 | 0.09 | 0.20 | 0.20 | Conventional inserts | 1 | 0.34 | 0.40 | 0.49 |
| | 2 | 0.10 | 0.17 | 0.21 | | 2 | 0.34 | 0.36 | 0.45 |
| | 3 | 0.11 | 0.16 | 0.21 | | 3 | 0.36 | 0.41 | 0.49 |
| | 4 | 0.11 | 0.16 | 0.21 | | 4 | 0.35 | 0.37 | 0.47 |
| | 5 | 0.10 | 0.17 | 0.19 | | 5 | 0.35 | 0.40 | 0.46 |
| | 6 | 0.09 | 0.16 | 0.21 | | 6 | 0.37 | 0.42 | 0.49 |
| | 7 | 0.09 | 0.18 | 0.22 | | 7 | 0.34 | 0.39 | 0.44 |
| | 8 | 0.11 | 0.20 | 0.19 | | 8 | 0.36 | 0.38 | 0.46 |
| | 9 | 0.13 | 0.16 | 0.20 | | 9 | 0.34 | 0.43 | 0.49 |
| | 10 | 0.11 | 0.19 | 0.20 | | 10 | 0.33 | 0.36 | 0.44 |
| | 11 | 0.10 | 0.18 | 0.22 | | 11 | 0.34 | 0.43 | 0.47 |
| | 12 | 0.11 | 0.17 | 0.21 | | 12 | 0.34 | 0.40 | 0.46 |
| | 13 | 0.09 | 0.18 | 0.20 | | 13 | 0.38 | 0.41 | 0.48 |
| | 14 | 0.09 | 0.19 | 0.22 | | 14 | 0.34 | 0.38 | 0.49 |
| | 15 | 0.12 | 0.17 | 0.18 | | 15 | 0.33 | 0.37 | 0.44 |

The results, shown in Tables 10-14, indicate that the inserts 1-15 according to the present embodiment exhibit excellent wear resistance even in a high-speed cutting process which involves generation of high heat. This is because the binding phases of TiCN-based cermets, which are common components in the inserts 1-15 according to the present embodiment, gain an excellent degree of high-temperature hardness due to high percentages (40-60%) of W components contained therein. On the other hand, in the conventional inserts 1-15, the percentages of W contained in the binding phases are low (1-10%). Therefore, a good degree of high-temperature hardness cannot be expected in the binding phases, and progress of wear in the above-described binding phases is facilitated, particularly in a high-speed cutting process. This apparently causes the usage-life of the conventional inserts to end relatively in a short period of time.

As described above, the inserts according to the present embodiment exhibit excellent wear resistance, not only in a cutting process for cutting various types of steel, cast iron, and so on under normal conditions, but also in a high-speed cutting process which involves generation of high heat. As a result, the inserts according to the present embodiment can be fully satisfied in terms of saving power, energy, and cost in cutting processes.

Embodiment 4

As raw material powders, powders of $(Ti_{0.95}Nb_{0.05})C_{0.5}N_{0.5}$ (Raw material A in Table 15), powders of $(Ti_{0.9}Nb_{0.1})Co_{0.5}N_{0.5}$ (Raw material B in Table 15), powders of $(Ti_{0.85}Nb_{0.15})C_{0.5}N_{0.5}$, (Raw material C in Table 15), powders of $(Ti_{0.9}Nb_{0.1})C_{0.4}N_{0.6}$ (Raw material D in Table 15), powders of $(Ti_{0.0}Nb_{0.1})C_{0.6}N_{0.4}$ (Raw material E in Table 15) (the ratios of contained raw material powders, such as in $(Ti_{0.95}Nb_{0.05})C_{0.5}N_{0.5}$, indicate atom ratios), powders of NbC, powders of TaC, powders of WC, powders of Co, and powders of Ni respectively having mean particle sizes ranging from 0.5 to 2 μm were prepared. These raw material powders were combined according to the blended compositions shown in Table 15, wet-mixed by a ball mill for 24 hours, and dried. Subsequently, each type of the dried powders was pressed at pressure of 98 MPa into a shape of a compact. Each of the compacts was sintered under the following conditions:

(a) from room temperature to 1280° C., temperature was increased at the speed of 2° C./min. in a vacuum atmosphere equal to or smaller than 10 pa;

(b) once the temperature was increased to 1280° C., an atmosphere alternating process was performed wherein a short Ar atmosphere retention, in which an Ar atmosphere at 35 kPa was retained for 2 minutes, and a short vacuum atmosphere, in which a vacuum atmosphere equal to or smaller than 10Pa was retained for 10 minutes, were alternatively repeated the number of times shown in Table 15;

(c) subsequent to the above-described atmosphere alternating process, temperature was increased up to 1420° C. at the speed of 2° C./min. in a vacuum atmosphere equal to or smaller than 10 Pa;

(d) from 1420° C. to a predetermined sintering temperature in the range of 1480-1660° C., the temperature was increased at the speed of 2° C./min., and the aforementioned sintering temperature was retained for 1.5 hours in a nitrogen atmosphere at 1300 Pa; and (e) a furnace was cooled from the above-described sintering temperature in a vacuum atmosphere equal to or smaller than 10 Pa.

Sintering was performed according to the above-described processes (a)-(e). After sintering, honing (R: 0.07 mm)was performed to cutting edges 80 as to produce the inserts 1-10 according to the present embodiment which respectively have tip shapes in compliance with the ISO standard CNMG120412.

For a comparison purpose, as shown below in Table 16, conventional inserts 1-10 were also produced. The conventional inserts 1-10 were made substantially under the same conditions except that powders of $TiC_{0.5}N_{0.5}$ (the ratio of C/N is indicated by atom ratio, such as $TiC_{0.5}N_{0.5}$) having a mean particle size of 1 μm was used as raw material powders instead of the above-described Raw materials A-E, and that the above-described atmosphere alternating process was not performed while the temperature was increased to the sintering temperature.

With respect to the inserts 1-10 according to the present embodiment and the conventional inserts 1-10 obtained as a result of the above-described production, microstructure observation of cermets constituting the aforementioned inserts was performed by a scanning electron microscope, and analysis of binding phases was performed. The results were respectively shown in A Tables 17 and 18.

Figure 14:
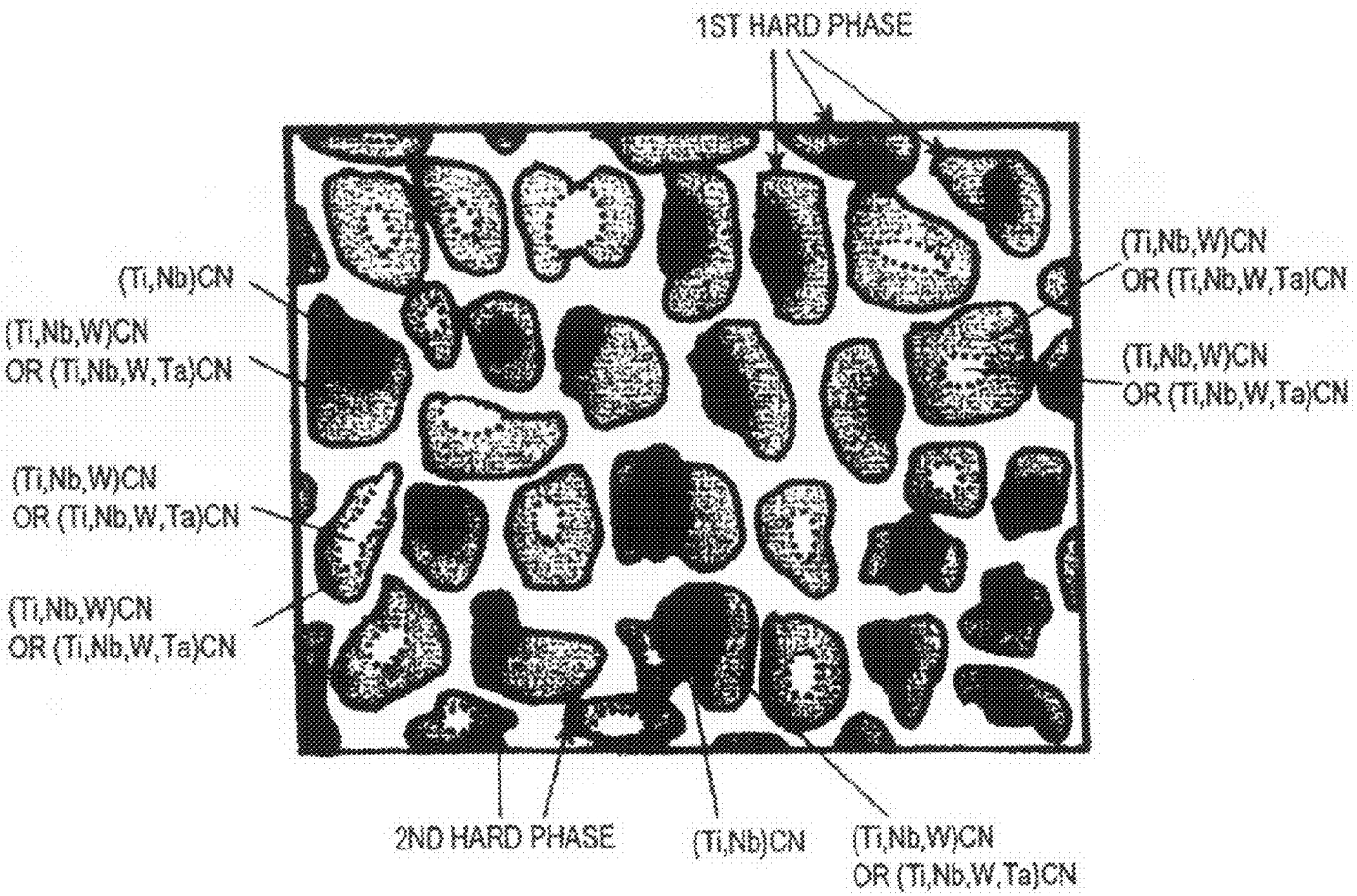
FIG. 14 is an explanatory view schematically showing a longitudinal section of a sample according to Embodiment 4 observed by a transmission electron microscope.

FIG. 14 schematically shows the result of the microstructure observation of the cermet according to the present embodiment by a scanning electron microscope (magnification 10,000).

Subsequently, each of the above-described inserts 1-10 according to the present embodiment and the conventional inserts 1-10 was fastened to a leading end portion of a steel shank tool bar with a screw through a fixture. Then, following tests were performed in the above-described state under the conditions described below.

One type of cutting tests was performed, in which dry cutting of alloy steel was intermittently performed at high speed (normal cutting speed in a cutting process of alloy steel is 200 m/min) under the following conditions (to be referred to as Cutting condition A):

Cut material: a round bar in compliance with JIS-SCM440,
Cutting speed: 350 m/min,
Depth of cut: 1 mm,
Feed: 0.2 mm/rev, and
Cutting time: 20 minutes.

Another type of cutting tests was performed, in which dry cutting of carbon steel was intermittently performed at high speed (normal cutting speed in a cutting process of carbon steel is 250 m/min) under the following conditions (to be referred to as Cutting condition B):

Cut material: a round bar in compliance with JIS-S20C having 4 longitudinal grooves spaced evenly in the length direction,
Cutting speed: 350 m/min,
Depth of cut: 1.5 mm,
Feed: 0.2 mm/rev, and
Cutting time: 10 minutes.

Still another type of cutting tests was performed, in which dry cutting of cast iron was intermittently performed at high speed (normal cutting speed in a cutting process of cast iron is 280 m/min) under the following conditions (to be referred to as Cutting condition C):

Cut material: a round bar in compliance with JIS-FC300,
Cutting speed: 420 m/min,
Depth of cut: 2.5 mm,
Feed: 0.3 mm/rev, and
Cutting time: 20 minutes.

In all types of cutting tests, the widths of flank wear of the cutting edges were measured. The measurement results are shown in Table 19.

TABLE 15

| | | Blended composition (mass %) | | | | | | | | | | Atmosphere alternating process while temperature is increasing | |
|---|---|---|---|---|---|---|---|---|---|---|---|---|---|
| Type | | Raw material A | Raw material B | Raw material C | Raw material D | Raw material E | WC | TaC | NbC | Co | Ni | Number of short Ar atmosphere retention | Number of short vacuum atmosphere retention |
| Inserts of present embodiment | 1 | 25 | 25 | — | — | — | 20 | 10 | — | 10 | 10 | 2 | 2 |
| | 2 | — | 25 | 28 | — | — | 22 | — | 5 | 10 | 10 | 2 | 3 |
| | 3 | — | — | 25 | 30 | — | 25 | 5 | 5 | 5 | 5 | 3 | 2 |
| | 4 | — | — | — | 27 | 25 | 28 | — | 7 | 6 | 7 | 3 | 3 |
| | 5 | 25 | — | 25 | — | — | 30 | 10 | — | 5 | 5 | 3 | 4 |
| | 6 | — | 25 | — | 35 | — | 25 | 1 | 4 | 5 | 5 | 4 | 3 |
| | 7 | 10 | 23 | — | — | 25 | 22 | 5 | — | 6 | 9 | 4 | 4 |
| | 8 | — | 10 | — | 25 | 20 | 25 | 4 | 3 | 8 | 5 | 5 | 4 |
| | 9 | 17 | — | 10 | 20 | 10 | 28 | — | 5 | 5 | 5 | 5 | 5 |
| | 10 | 10 | 10 | 10 | 10 | 10 | 30 | — | 7 | 6 | 7 | 6 | 6 |

TABLE 16

| Type | | Blended composition (mass %) $TiC_{0.5}N_{0.5}$ | WC | TaC | NbC | Co | Ni | Atmosphere alternating process while temperature is increasing: Number of short Ar atmosphere retention | Number of short vacuum atmosphere retention |
|---|---|---|---|---|---|---|---|---|---|
| Conventional inserts | 1 | 50 | 20 | 10 | — | 10 | 10 | — | — |
| | 2 | 53 | 22 | — | 5 | 10 | 10 | — | — |
| | 3 | 55 | 25 | 5 | 5 | 5 | 5 | — | — |
| | 4 | 52 | 28 | — | 7 | 6 | 7 | — | — |
| | 5 | 50 | 30 | 10 | — | 5 | 5 | — | — |
| | 6 | 60 | 25 | 1 | 4 | 5 | 5 | — | — |
| | 7 | 58 | 22 | 5 | — | 6 | 9 | — | — |
| | 8 | 55 | 25 | 4 | 3 | 8 | 5 | — | — |
| | 9 | 57 | 28 | — | 5 | 5 | 5 | — | — |
| | 10 | 50 | 30 | — | 7 | 6 | 7 | — | — |

TABLE 17

| Type | | Cermet: Microstructure (area %) Hard phase | Binding phase | Component composition of binding phase (mass %) Co | Ni | Ti | Ta | Nb | W + impurities |
|---|---|---|---|---|---|---|---|---|---|
| Inserts of present embodiment | 1 | 75.2 | remainder | 29.5 | 29.2 | 0.4 | 0.4 | — | remainder (cont. W: 40.1%) |
| | 2 | 78.9 | remainder | 28.3 | 27.9 | 0.4 | — | 0.6 | remainder (cont. W: 42.5%) |
| | 3 | 86.8 | remainder | 18.0 | 20.2 | 0.9 | 0.4 | 0.5 | remainder (cont. W: 59.9%) |
| | 4 | 82.4 | remainder | 18.5 | 21.6 | 0.9 | — | 1.0 | remainder (cont. W: 57.9%) |
| | 5 | 89.8 | remainder | 27.5 | 27.7 | 1.8 | 1.1 | — | remainder (cont. W: 41.6%) |
| | 6 | 87.3 | remainder | 20.3 | 20.1 | 1.6 | 0.6 | 0.6 | remainder (cont. W: 56.7%) |
| | 7 | 84.7 | remainder | 22.1 | 34.9 | 1.9 | 1.0 | — | remainder (cont. W: 40.0%) |
| | 8 | 86.0 | remainder | 33.0 | 20.4 | 2.2 | 0.8 | 0.9 | remainder (cont. W: 42.5%) |
| | 9 | 87.4 | remainder | 21.0 | 20.3 | 2.5 | — | 1.4 | remainder (cont. W: 54.5%) |
| | 10 | 84.0 | remainder | 21.0 | 24.6 | 2.8 | — | 2.0 | remainder (cont. W: 49.4%) |

TABLE 18

| Type | | Cermet: Microstructure (area %) Hard phase | Binding phase | Component composition of binding phase (mass %) W | Ti | Ta | Nb | Ni | Co + impurities |
|---|---|---|---|---|---|---|---|---|---|
| Conventional inserts | 1 | 83.9 | remainder | 2.4 | 0.5 | 0.5 | — | 48.4 | remainder (cont. Co: 48.0%) |
| | 2 | 84.2 | remainder | 6.7 | 0.6 | — | 0.4 | 46.2 | remainder (cont. Co: 45.8%) |
| | 3 | 91.9 | remainder | 10.0 | 0.9 | 0.6 | 0.5 | 44.0 | remainder (cont. Co: 43.9%) |
| | 4 | 89.3 | remainder | 9.8 | 1.1 | — | 1.0 | 47.6 | remainder (cont. Co: 40.4%) |

TABLE 18-continued

| Type | | Cermet | | | | | | | |
|---|---|---|---|---|---|---|---|---|---|
| | | Microstructure (area %) | | Component composition of binding phase (mass %) | | | | | |
| | | Hard phase | Binding phase | W | Ti | Ta | Nb | Ni | Co + impurities |
| | 5 | 91.4 | remainder | 7.1 | 2.0 | 0.8 | — | 45.1 | remainder (cont. Co: 44.7%) |
| | 6 | 92.4 | remainder | 4.1 | 1.9 | 0.5 | 0.6 | 46.3 | remainder (cont. Co: 46.3%) |
| | 7 | 88.6 | remainder | 1.2 | 2.1 | 0.8 | — | 59.5 | remainder (cont. Co: 36.3%) |
| | 8 | 89.7 | remainder | 4.6 | 2.0 | 1.0 | 0.8 | 35.1 | remainder (cont. Co: 56.2%) |
| | 9 | 92.3 | remainder | 2.1 | 1.8 | — | 1.7 | 47.1 | remainder (cont. Co: 47.0%) |
| | 10 | 89.3 | remainder | 6.4 | 3.1 | — | 2.0 | 47.7 | remainder (cont. Co: 40.6%) |

TABLE 19

| Type | | Widths of flank wear (mm) | | | Type | | Widths of flank wear (mm) | | |
|---|---|---|---|---|---|---|---|---|---|
| | | Cutting condition A | Cutting condition B | Cutting condition C | | | Cutting condition A | Cutting condition B | Cutting condition C |
| Inserts of present embodiment | 1 | 0.17 | 0.11 | 0.19 | Conventional inserts | 1 | 0.44 | 0.34 | 0.45 |
| | 2 | 0.18 | 0.10 | 0.22 | | 2 | 0.45 | 0.37 | 0.53 |
| | 3 | 0.15 | 0.11 | 0.21 | | 3 | 0.42 | 0.34 | 0.53 |
| | 4 | 0.15 | 0.12 | 0.23 | | 4 | 0.38 | 0.41 | 0.49 |
| | 5 | 0.16 | 0.13 | 0.20 | | 5 | 0.42 | 0.33 | 0.46 |
| | 6 | 0.17 | 0.13 | 0.20 | | 6 | 0.45 | 0.42 | 0.51 |
| | 7 | 0.16 | 0.09 | 0.18 | | 7 | 0.39 | 0.41 | 0.46 |
| | 8 | 0.14 | 0.08 | 0.21 | | 8 | 0.38 | 0.35 | 0.47 |
| | 9 | 0.15 | 0.12 | 0.19 | | 9 | 0.43 | 0.37 | 0.45 |
| | 10 | 0.18 | 0.11 | 0.20 | | 10 | 0.42 | 0.40 | 0.54 |

The results, shown in Tables 15-19, indicate that the inserts 1-10 according to the present embodiment exhibit excellent wear resistance even in a high-speed cutting process which involves generation of high heat. This is because that the binding phases of cermets, which are common components in the inserts 1-10 according to the present embodiment, gain an excellent degree of high-temperature hardness due to high percentages (40-60%) of W component contained therein, and, in addition, that the core portions of the hard phases have a high degree of high-temperature hardness due to Nb component contained therein. On the other hand, in the conventional inserts 1-10, the percentages of W contained in the binding phases are low (1-10%). Therefore, a good degree of high-temperature hardness cannot be expected in the binding phases, and progress of wear in the above-described binding phases is facilitated, particularly in a high-speed cutting process. This apparently causes the usage-life of the conventional inserts to end relatively in a short period of time.

As described above, the inserts according to the present embodiment exhibit excellent wear resistance, not only in a cutting process for cutting various types of steel, cast iron, and so on under normal conditions, but also in a high-speed cutting process which involves generation of high heat. As a result, the inserts according to the present embodiment can be fully satisfied in terms of saving power, energy, and cost in cutting processes.

Embodiment 6

As raw material powders, powders of $(Ti_{0.85}Nb_{0.05}Zr_{0.1})C_{0.5}N_{0.5}$, (Raw material a in Table 20), powders of $(Ti_{0.8}Nb_{0.1}Zr_{0.1})C_{0.5}N_{0.5}$ (Raw material b in Table 20), powders of $(Ti_{0.75}Nb_{0.15}Zr_{0.1})C_{0.5}N_{0.5}$ (Raw material c in Table 20), powders of $(Ti_{0.85}Nb_{0.1}Zr_{0.05})C_{0.5}N_{0.5}$ (Raw material d in Table 20), powders of $(Ti_{0.75}Nb_{0.1}Zr_{0.15})C_{0.5}N_{0.5}$ (Raw material e in Table 20), powders of $(Ti_{0.8}Nb_{0.1}Zr_{0.1})C_{0.4}N_{0.6}$ (Raw material f in Table 20), powders of $(Ti_{0.8}Nb_{0.1}Zr_{0.1})C_{0.6}N_{0.4}$ (Raw material g in Table 20) (the ratios of the contained raw material powders, such as in $(Ti_{0.85}Nb_{0.05}Zr_{0.1})C_{0.5}N_{0.5}$, indicate atom ratios), powders of NbC, powders of TaC, powders of WC, powders of Co, and powders of Ni respectively having mean particle sizes ranging from 0.5 to 2 μm were prepared. These raw material powders were combined according to the blended compositions shown in Table 20, wet-mixed by a ball mill for 24 hours, and dried. Subsequently, each type of the dried powders was pressed at pressure of 98 MPa into a shape of a compact. Each of the compacts was sintered under the following conditions:

(a) from room temperature to 1280° C., temperature was increased at the speed of 2° C./min. in a vacuum atmosphere equal to or smaller than 10 Pa;

(b) once the temperature was increased to 1280° C., an atmosphere alternating process was performed wherein a short Ar atmosphere retention, in which an Ar atmosphere at 35 kPa was retained for 2 minutes, and a short vacuum atmosphere, in which a vacuum atmosphere equal to or smaller than 10 Pa was retained for 10 minutes, were alternatively repeated the number of times shown in Table 20;

(c) subsequent to the above-described atmosphere alternating process, temperature was increased up to 1420° C. at the speed of 2° C./min. in a vacuum atmosphere equal to or smaller than 10 Pa;

(d) from 1420° C. to a predetermined sintering temperature in the range of 1480-1560° C., the temperature was increased at the speed of 2° C./min., and the aforementioned sintering temperature was retained for 1.5 hours in a nitrogen atmosphere at 1300 Pa; and (e) a furnace was cooled from the above-described sintering temperature in a vacuum atmosphere equal to or smaller than 10 Pa.

Sintering was performed according to the above-described processes (a)-(e). After sintering, honing (R: 0.07 mm) was performed to cutting edges so as to produce the inserts 1-10 according to the present embodiment which respectively have tip shapes in compliance with the ISO standard CNMG120412.

For a comparison purpose, as shown below in Table 21, conventional inserts 1-10 were also produced. The conventional inserts 1-10 were made substantially under the same conditions except that powders of $TiC_{0.5}N_{0.5}$ (the ratio of C/N is indicated by atom ratio, such as $TiC_{0.5}N_{0.5}$) having a mean particle size of 1 μm was used as raw material powders instead of the above-described Raw materials a-f, and that the above-described atmosphere alternating process was not performed while the temperature was increased to the sintering temperature.

With respect to the inserts 1-10 according to the present embodiment and the conventional inserts 1-10 obtained as a result of the above-described production, microstructure observation of cermets constituting the aforementioned inserts was performed by a scanning electron microscope, and analysis of binding phases was performed. The results were respectively shown in Tables 22 and 23.

Figure 15:
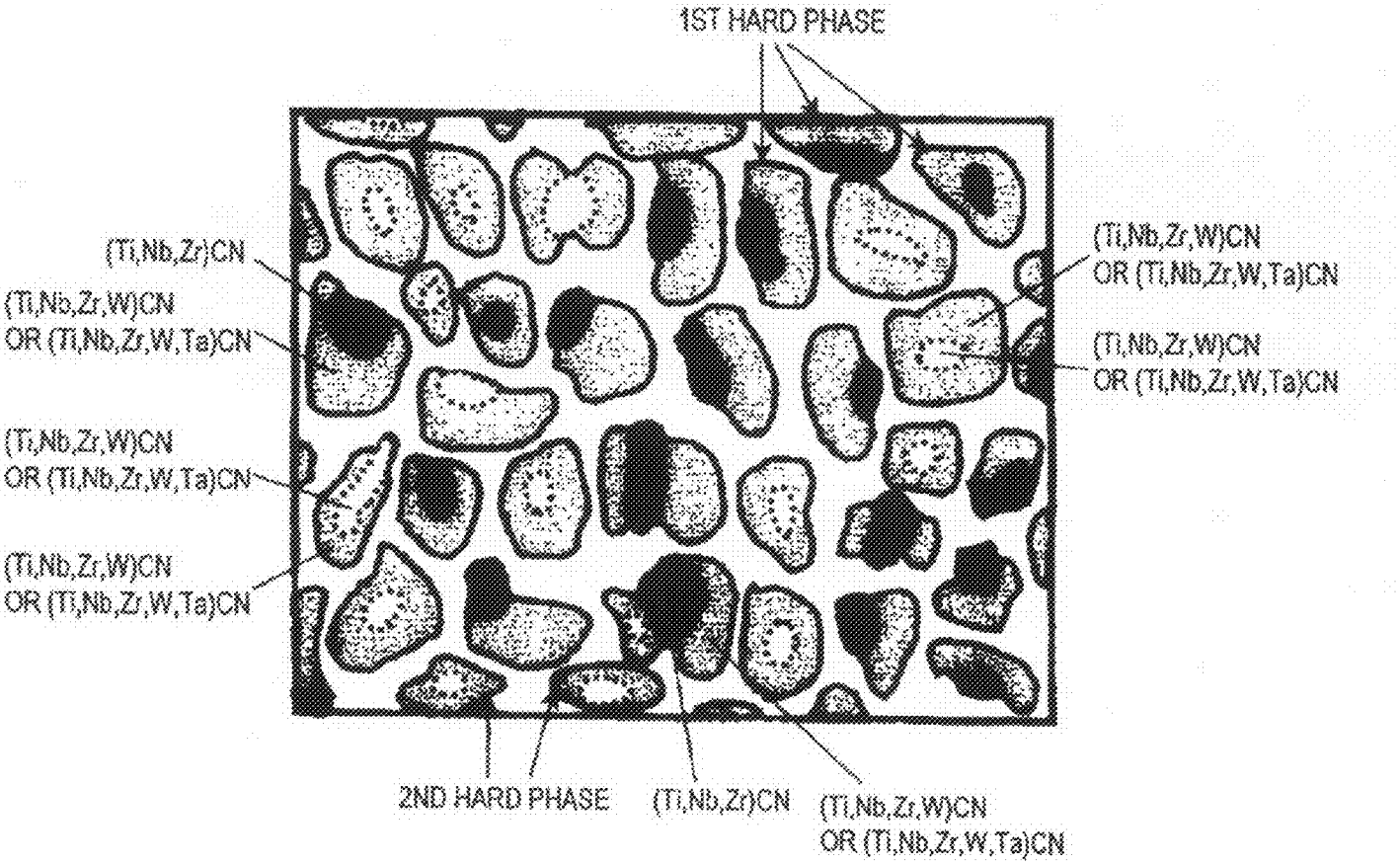
FIG. 15 is an explanatory view schematically showing a longitudinal section of a sample according to Embodiment 6 observed by a transmission electron microscope.

FIG. 15 schematically shows the result of the microstructure observation of the cermet according to the present embodiment by a scanning electron microscope (magnification 10,000).

Subsequently, each of the above-described inserts 1-10 according to the present embodiment and the conventional inserts 1-10 was fastened to a leading end portion of a steel shank tool bar with a screw through a fixture. Then, following tests were performed in the above-described state under the conditions described below.

One type of cutting tests was performed, in which dry cutting of alloy steel was intermittently performed at high speed (normal cutting speed in a cutting process of alloy steel is 200 m/min) under the following conditions (to be referred to as Cutting condition A):

Cut material: a round bar in compliance with JIS-SCM440,
Cutting speed: 350m/min,
Depth of cut: 1 mm,
Feed: 0.2 mm/rev, and
Cutting time: 20 minutes.

Another type of cutting tests was performed, in which dry cutting of carbon steel was intermittently performed at high speed (normal cutting speed in a cutting process of carbon steel is 250 m/min) under the following conditions (to be referred to as Cutting condition B):

Cut material: a round bar in compliance with JIS-S20C having 4 longitudinal grooves spaced evenly in the length direction,
Cutting speed: 380 m/min,
Depth of cut: 1.5 mm,
Feed: 0.2 mm/rev, and
Cutting time: 10 minutes.

Still another type of cutting tests was performed, in which dry cutting of cast iron was intermittently performed at high speed (normal cutting speed in a cutting process of cast iron is 280 m/min) under the following conditions (to be referred to as Cutting condition C):

Cut material: a round bar in compliance with JIS-FC300,
Cutting speed: 400 m/min,
Depth of cut: 2.5 mm,
Feed: 0.3 mm/rev, and
Cutting time: 20 minutes.

In all types of cutting tests, the widths of flank wear of the cutting edges were measured. The measurement results are shown in Table 24.

TABLE 20

| | | Blended composition (mass %) | | | | | | | | | | | | Atmosphere alternating process while temperature is increasing | |
|---|---|---|---|---|---|---|---|---|---|---|---|---|---|---|---|
| Type | | Raw material a | Raw material b | Raw material c | Raw material d | Raw material e | Raw material f | Raw material g | WC | TaC | NbC | Co | Ni | Number of short Ar atmosphere retention | Number of short vacuum atmosphere retention |
| Inserts of present embodiment | 1 | 25 | 25 | — | — | — | — | — | 20 | 10 | — | 10 | 10 | 2 | 2 |
| | 2 | — | 25 | 28 | — | — | — | — | 22 | — | 5 | 10 | 10 | 2 | 3 |
| | 3 | — | — | 25 | 20 | 10 | — | — | 25 | 5 | 5 | 5 | 5 | 3 | 2 |
| | 4 | — | — | — | 12 | 20 | 20 | — | 28 | — | 7 | 6 | 7 | 3 | 3 |
| | 5 | — | — | — | — | 15 | 25 | 10 | 30 | 10 | — | 5 | 5 | 3 | 4 |
| | 6 | 10 | 20 | 15 | 15 | — | — | — | 25 | 1 | 4 | 5 | 5 | 4 | 3 |
| | 7 | 20 | — | 8 | — | — | 20 | 10 | 22 | 5 | — | 6 | 9 | 4 | 4 |
| | 8 | — | 5 | 10 | 15 | 10 | 15 | — | 25 | 4 | 3 | 8 | 5 | 5 | 4 |
| | 9 | 10 | 10 | — | 7 | 10 | 10 | 10 | 28 | — | 5 | 5 | 5 | 5 | 5 |
| | 10 | 5 | 10 | 5 | 8 | 7 | 10 | 5 | 30 | — | 7 | 6 | 7 | 6 | 6 |

TABLE 21

| Type | | Blended composition (mass %) | | | | | | Atmosphere alternating process while temperature is increasing | |
|---|---|---|---|---|---|---|---|---|---|
| | | $TiC_{0.5}N_{0.5}$ | WC | TaC | NbC | Co | Ni | Number of short Ar atmosphere retention | Number of short vacuum atmosphere retention |
| Conventional inserts | 1 | 50 | 20 | 10 | — | 10 | 10 | — | — |
| | 2 | 53 | 22 | — | 5 | 10 | 10 | — | — |
| | 3 | 55 | 25 | 5 | 5 | 5 | 5 | — | — |
| | 4 | 52 | 28 | — | 7 | 6 | 7 | — | — |
| | 5 | 50 | 30 | 10 | — | 5 | 5 | — | — |
| | 6 | 60 | 25 | 1 | 4 | 5 | 5 | — | — |
| | 7 | 58 | 22 | 5 | — | 6 | 9 | — | — |
| | 8 | 55 | 25 | 4 | 3 | 8 | 5 | — | — |
| | 9 | 57 | 28 | — | 5 | 5 | 5 | — | — |
| | 10 | 50 | 30 | — | 7 | 6 | 7 | — | — |

20

TABLE 22

| Type | | Cermet | | | | | | | |
|---|---|---|---|---|---|---|---|---|---|
| | | Microstructure (area %) | | Component composition of binding phase (mass %) | | | | | |
| | | Hard phase | Binding phase | Co | Ni | Ti | Ta | Nb | W + impurities |
| Inserts of present embodiment | 1 | 75.0 | remainder | 29.0 | 29.5 | 0.5 | 0.6 | — | remainder (cont. W: 40.0%) |
| | 2 | 77.4 | remainder | 25.4 | 25.5 | 0.3 | — | 0.6 | remainder (cont. W: 47.9%) |
| | 3 | 86.8 | remainder | 18.2 | 20.0 | 0.8 | 0.4 | 0.4 | remainder (cont. W: 59.8%) |
| | 4 | 84.3 | remainder | 21.7 | 25.3 | 1.2 | — | 0.6 | remainder (cont. W: 51.0%) |
| | 5 | 89.9 | remainder | 28.7 | 29.0 | 1.1 | 0.8 | — | remainder (cont. W: 40.3%) |
| | 6 | 88.8 | remainder | 25.5 | 24.6 | 1.5 | 0.7 | 0.6 | remainder (cont. W: 47.0%) |
| | 7 | 84.4 | remainder | 21.1 | 34.8 | 1.6 | 0.8 | — | remainder (cont. W: 41.6%) |
| | 8 | 86.0 | remainder | 32.9 | 20.6 | 2.0 | 0.7 | 0.8 | remainder (cont. W: 42.9%) |
| | 9 | 86.3 | remainder | 18.4 | 18.3 | 2.3 | — | 1.6 | remainder (cont. W: 59.0%) |
| | 10 | 84.5 | remainder | 21.3 | 24.8 | 2.4 | — | 1.5 | remainder (cont. W: 49.9%) |

TABLE 23

| Type | | Cermet | | | | | | | |
|---|---|---|---|---|---|---|---|---|---|
| | | Microstructure (area %) | | Component composition of binding phase (mass %) | | | | | |
| | | Hard phase | Binding phase | W | Ti | Ta | Nb | Ni | Co + impurities |
| Conventional inserts | 1 | 83.4 | remainder | 7.4 | 0.5 | 0.3 | — | 45.8 | remainder (cont. Co: 45.7%) |
| | 2 | 84.3 | remainder | 6.1 | 0.6 | — | 0.6 | 46.4 | remainder (con. Co: 46.1%) |
| | 3 | 91.9 | remainder | 9.2 | 0.9 | 0.5 | 0.4 | 44.4 | remainder (cont. Co: 44.5%) |

TABLE 23-continued

| Type | | Cermet: Microstructure (area %) Hard phase | Binding phase | Component composition of binding phase (mass %) W | Ti | Ta | Nb | Ni | Co + impurities |
|---|---|---|---|---|---|---|---|---|---|
| | 4 | 89.7 | remainder | 2.6 | 0.9 | — | 0.8 | 51.3 | remainder (cont. Co: 44.1%) |
| | 5 | 91.3 | remainder | 9.3 | 1.6 | 1.3 | — | 44.0 | remainder (cont. Co: 43.7%) |
| | 6 | 92.4 | remainder | 3.5 | 1.7 | 0.6 | 0.7 | 46.7 | remainder (cont. Co: 46.7%) |
| | 7 | 88.5 | remainder | 2.9 | 1.6 | 0.5 | — | 59.9 | remainder (cont. Co: 35.0%) |
| | 8 | 89.5 | remainder | 8.7 | 1.9 | 1.1 | 1.0 | 35.0 | remainder (cont. Co: 52.2%) |
| | 9 | 92.0 | remainder | 9.1 | 2.1 | — | 1.9 | 43.5 | remainder (cont. Co: 43.2%) |
| | 10 | 89.3 | remainder | 7.3 | 2.9 | — | 1.8 | 47.4 | remainder (cont. Co: 40.5%) |

TABLE 24

| Type | | Widths of flank wear (mm) Cutting condition A | Cutting condition B | Cutting condition C | Type | | Widths of flank wear (mm) Cutting condition A | Cutting condition B | Cutting condition C |
|---|---|---|---|---|---|---|---|---|---|
| Cutting tip of present invention | 1 | 0.15 | 0.09 | 0.18 | Conventional cutting tip | 1 | 0.37 | 0.44 | 0.50 |
| | 2 | 0.19 | 0.08 | 0.19 | | 2 | 0.41 | 0.36 | 0.53 |
| | 3 | 0.14 | 0.09 | 0.17 | | 3 | 0.43 | 0.42 | 0.44 |
| | 4 | 0.18 | 0.12 | 0.20 | | 4 | 0.36 | 0.41 | 0.45 |
| | 5 | 0.14 | 0.11 | 0.18 | | 5 | 0.40 | 0.43 | 0.51 |
| | 6 | 0.17 | 0.13 | 0.19 | | 6 | 0.38 | 0.39 | 0.48 |
| | 7 | 0.20 | 0.05 | 0.17 | | 7 | 0.42 | 0.37 | 0.47 |
| | 8 | 0.20 | 0.12 | 0.18 | | 8 | 0.40 | 0.41 | 0.45 |
| | 9 | 0.19 | 0.09 | 0.17 | | 9 | 0.41 | 0.43 | 0.49 |
| | 10 | 0.18 | 0.08 | 0.15 | | 10 | 0.42 | 0.35 | 0.47 |

The results, shown in Tables 20-24, indicate that the inserts 1-10 according to the present embodiment are not chipped and exhibit excellent wear resistance, even in a high-speed cutting process which involves generation of high heat. This is because that the binding phases of cermets, which are common components in the inserts according to the present embodiment, gain an excellent degree of high-temperature hardness due to high percentages (40-60%) of W components contained therein. In addition, this is also because that the core portions of the hard phases have a high degree of high-temperature hardness due to Nb component and Zr component contained therein, and exhibit excellent wettability when the inserts 1-10 of the present embodiment are sintered. On the other hand, in the conventional inserts 1-10, the percentages of W contained in the binding phases are low (1-10%). Therefore, a good degree of high-temperature hardness cannot be expected in the binding phases, and progress of wear in the above-described binding phases is facilitated, particularly in a high-speed cutting process. This apparently causes the usage-life of the conventional inserts to end relatively in a short period of time.

As described above, the inserts according to the present embodiment exhibit excellent wear resistance, not only in a cutting process for cutting various types of steel, cast iron, and so on under normal conditions, but also in a high-speed cutting process which involves generation of high heat. As a result, the inserts according to the present embodiment can be fully satisfied in terms of saving power, energy, and cost in cutting processes.

Embodiment 6 a) Firstly, an insert according to the present embodiment is described.

As shown in the aforementioned FIG. 5, an insert 1 according to the present embodiment is a cutting tip made with a sintered body shaped in compliance with the ISO standard SNGN120408.

The insert 1 is constituted with, as shown in the above-described FIG. 1, a microstructure including hard phases (hard particles) and a binding phase existing so as to surround the hard phases (the microstructure contains inevitable impurities). Each of the hard phases is constituted with (Ti, W, Ta/Nb)CN and titanium carbonitride. The binding phase is mainly constituted with W, Co and/or Ni.

In the composition of the sintered body of the insert 1, Ti, Nb and/or Ta, and W are contained such that a sum of an amount of Ti converted as carbonitride, an amount of Nb and/or Ta converted as carbide, and an amount of W converted as carbide becomes 70-95 mass % of the entire insert. In the composition, W is contained as much as the amount of W converted as carbide becomes 20-35 mass % of the entire microstructure.

Moreover, Ti is contained as much as the amount of Ti converted as carbonitride becomes 46-60 mass % of the entire microstructure. Nb and/or Ta are/is contained as much as the amount of Nb and/or Ta converted as carbide becomes 5-10 mass %.

Furthermore, the hard phases contains W as much as the amount of W converted as carbide becomes 40-65 mass % of the entire microstructure. The binding phase contains the rest of W.

Still furthermore, as the hard phases, for example, the insert 1 includes all the hard phases described in the following (1)-(3):

(1) a first hard phase of core-having structure whose core portion contains a titanium carbonitride phase, and whose peripheral portion contains a (Ti, W, Ta/Nb)CN phase;

(2) a second hard phase of core-having structure whose core portion and peripheral portion both contain a (Ti, W, Ta/Nb)CN phase; and (3) a third hard phase of single-phase structure constituted with a titanium carbonitride phase.

Because of the distinctive composition described above, the insert 1 according to the present embodiment is provided with both high wear resistance and breakage resistance, as proved by experiment examples described hereinafter.

The above-described insert 1 is secured, as shown in FIG. 6, to a leading end of a columnar holder 3, made of, for example, steel, by a fixture 5. Cutting of steel and the like is performed by using a cutting tool 7 wherein the insert 1 is secured to the holder 3.

b) The following describes a method for manufacturing the insert according to the present embodiment. In the following, the method for manufacturing inserts used in experiments to be described later, is explained here as an example.

In the present embodiment, wet mixing was firstly performed by using raw material powders.

Particularly, as shown below in Table 25, powders of $TiC_{0.5}N_{0.5}$ having a mean particle size ranging from 0.5 to 2 μm, powders of $TiC_{0.3}N_{0.7}$ having a mean particle size ranging from 0.5 to 2 μm, powders of WC having a mean particle size ranging from 1 to 2 μm, powders of Ta having a mean particle size ranging from 1 to 2 μm, powders of NbC having a mean particle size ranging from 1 to 2 μm, powders of Co having a mean particle size ranging from 2 to 3 μm, and powders of Ni having a mean particle size ranging from 2 to 3 μm are prepared. These raw material powders were blended according to the blended compositions shown below in Table 26 so as to make 4 types of mixed powders A-D.

TABLE 25

| | Blended composition (mass %) | | | | | | |
|---|---|---|---|---|---|---|---|
| Composition | $TiC_{0.5}N_{0.5}$ | $TiC_{0.3}N_{0.7}$ | WC | TaC | NbC | Co | Ni |
| A | 25 | 25 | 28 | — | 5 | 8 | 9 |
| B | 25 | 25 | 28 | 10 | — | 6 | 6 |
| C | 30 | 30 | 20 | — | 6 | 7 | 7 |
| D | 35 | 20 | 25 | — | 6 | 7 | 7 |

Subsequently, each of the above-described mixed powders A-D was wet-mixed in alcohol by a ball mill for 24 hours, and then dried.

Subsequently, each type of the dried powders was pressed at pressure of 98 MPa into a shape of a compact.

Figure 16:
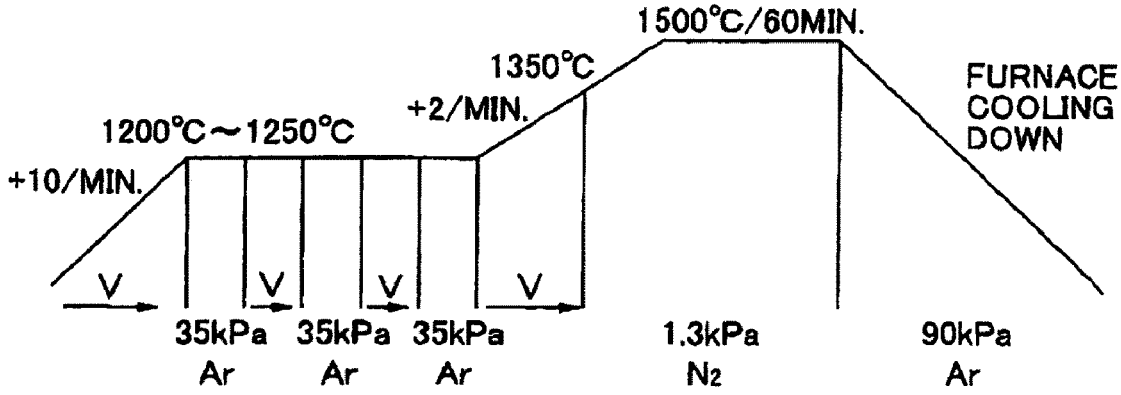
FIG. 16 is an explanatory view describing a manufacturing method of a cermet insert according to Embodiment 6.

Then, each of the compacts was sintered, as shown in FIG. 16, under the following sintering conditions (a)-(e):

(a) from room temperature to 1200° C., temperature was increased at the speed of 10° C./min. in a vacuum atmosphere (V) equal to or smaller than 10 Pa;

(b) after the temperature was increased to 1200° C. (intermediate temperature: temperature between 1200-1250° C. can be adopted as the intermediate temperature), an atmosphere alternating process was performed wherein a short Ar atmosphere retention, in which an Ar atmosphere at 36 kPa was retained for 2 minutes, and a short vacuum atmosphere, in which a vacuum atmosphere equal to or smaller than 10 Pa was retained for 15 minutes, were alternatively repeated;

(c) subsequent to the above-described atmosphere alternating process, the temperature was increased up to 1350° C. at the speed of 2° C./min. in a vacuum atmosphere equal to or smaller than 10 Pa;

(d) from 1350° C. to a predetermined sintering temperature (1500° C.), the temperature was increased at the speed of 2° C./min., and the aforementioned sintering temperature was retained for 60 minutes in a nitrogen atmosphere at 1.3 kPa; and (e) a furnace was cooled from the above-described sintering temperature in an Ar atmosphere equal to or smaller than 90 kPa.

Sintering was performed according to the above described processes (a)-(e). After sintering, grinding was performed so as to produce the insert 1 having a tip shape in compliance with the ISO standard SNGN120408.

In other words, as shown below in Table 26, inserts (Samples No. 1-4) were respectively produced corresponding to the above-described 4 types of mixed powders.

For a comparison purpose, as shown below in Table 26, inserts of comparative examples were also produced substantially under the same conditions except for the differences in the intermediate temperatures (Samples No. 6-8).

TABLE 26

| | No. | Composition | Intermediate temperature [° C.] |
|---|---|---|---|
| Present embodiment | 1 | A | 1200 |
| | 2 | B | 1200 |
| | 3 | C | 1250 |
| | 4 | D | 1250 |
| Comparative example | 5 | A | 1300 |
| | 6 | B | 1300 |
| | 7 | C | 1350 |
| | 8 | D | 1350 |

c) The following describes the composition analysis and the evaluations for cutting performances with respect to the inserts (Samples No. 1-4) according to the present invention and the inserts (Samples No. 5-8) according to the comparative examples which are made by the above-described manufacturing methods.

(1) Composition Analysis

According to EDS (Energy Dispersive Spectrometry), the amounts of components (elements), contained in the inserts (Samples No. 1-4) according to the present invention and the inserts (Samples 5-8) according to Comparative Examples were respectively assayed. Then, the amounts of the components were converted into the amounts of chemical compounds. The results are shown below in Tables 27 and 28.

TABLE 27

| | Sample | | Insert (sintered body) element composition [mass %] | | | | | |
|---|---|---|---|---|---|---|---|---|
| | No. | Blend | Ti | W | Ta | Nb | Co | Ni |
| Present embodiment | 1 | A | 44 | 35 | — | 5 | 8 | 8 |
| | 2 | B | 47 | 32 | 9 | — | 6 | 6 |
| | 3 | C | 53 | 28 | — | 6 | 6 | 7 |
| | 4 | D | 48 | 32 | — | 6 | 7 | 7 |
| Comparative example | 5 | A | 47 | 33 | — | 5 | 7 | 8 |
| | 6 | B | 47 | 30 | 11 | — | 6 | 6 |
| | 7 | C | 56 | 26 | — | 5 | 6 | 7 |
| | 8 | D | 52 | 30 | — | 5 | 6 | 7 |

TABLE 28

| | Sample | | Insert (sintered body) element converted amount [mass %] | | | | | |
|---|---|---|---|---|---|---|---|---|
| | No. | Blend | TiCN | WC | TaC | NbC | Co | Ni |
| Present embodiment | 1 | A | 49 | 32 | — | 5 | 7 | 7 |
| | 2 | B | 52 | 30 | 8 | — | 5 | 5 |
| | 3 | C | 58 | 25 | — | 6 | 5 | 6 |
| | 4 | D | 53 | 29 | — | 6 | 6 | 6 |
| Comparative example | 5 | A | 52 | 30 | — | 5 | 6 | 7 |
| | 6 | B | 50 | 30 | 10 | — | 5 | 5 |
| | 7 | C | 60 | 24 | — | 5 | 5 | 6 |
| | 8 | D | 54 | 30 | — | 5 | 5 | 6 |

In addition, the compositions of the binding phases of the inserts were analyzed by analysis in which a STEM (scanning transmission electron microscope) was used, and by EDS. The results are shown below in Table 29.

TABLE 29

| | Sample No. | Blend | Binding phase element composition [mass %] | | | | | |
|---|---|---|---|---|---|---|---|---|
| | | | Ti/ inevitable impurities | W | Ta | Nb | Co | Ni |
| Present embodiment | 1 | A | 1 | 53 | — | 1 | 22 | 23 |
| | 2 | B | 1 | 49 | 1 | — | 24 | 25 |
| | 3 | C | 1 | 44 | — | 1 | 27 | 27 |
| | 4 | D | 1 | 48 | — | 1 | 25 | 25 |
| Comparative example | 5 | A | 1 | 60 | — | 1 | 19 | 19 |
| | 6 | B | 1 | 59 | 1 | — | 19 | 20 |
| | 7 | C | 1 | 54 | — | 1 | 22 | 22 |
| | 8 | D | 1 | 59 | — | 1 | 19 | 20 |

Furthermore, the contained amount of W was obtained. The results are shown below in Table 30.

The amount of W contained in the binding phase with respect to the entire insert, the amount W contained in the hard phases with respect to the entire insert, and the amount of W contained in the binding phase with respect to the total amount of W can be respectively obtained from Formula <1>-Formula <3> described below. In order to calculate the amount of W, not converted values, but the amount of the element (mass %) is used.

Amount of W in binding phase[mass %]=(W in composition of binding phase)*(Co+Ni in composition of sintered body)/(Co+Ni in composition of binding phase) <1>

Amount of W in hard phases[mass %]=(amount of W in sintered body)−(amount of W in binding phase) 2>

Amount of W in binding phase with respect to total amount of W[mass %]=(amount W in binding phase)/(total amount of W) <3>

TABLE 30

| | Sample No. | Blend | W [mass %] | | W existing rate in binding phase/hard phase [%] | |
|---|---|---|---|---|---|---|
| | | | Value of Formula <1> Amount of W in binding phase with respect to entire insert | Value of Formula <2> Amount of W in hard phases with respect to entire insert | Value of Formula <3> Rate of W in binding phase with respect to total amount of W | Rate of W in hard phases with respect to total amount of W |
| Present embodiment | 1 | A | 19 | 16 | 54 | 46 |
| | 2 | B | 12 | 20 | 38 | 62 |
| | 3 | C | 11 | 17 | 38 | 62 |
| | 4 | D | 13 | 19 | 42 | 58 |
| Comparative example | 5 | A | 24 | 9 | 72 | 28 |
| | 6 | B | 18 | 12 | 61 | 39 |
| | 7 | C | 16 | 10 | 61 | 39 |
| | 8 | D | 20 | 10 | 66 | 84 |

(2) Breakage Resistance Test

Each of the sample inserts was fastened to the leading end portion of a steel shank tool bar (holder) with a screw through a fixture, and a cutting tool was made.

By using the cutting tool, cutting tests were performed, in which dry cutting of alloy steel was intermittently performed at high speed, under the cutting conditions described below in Table 31. In the breakage resistance test, 20 pieces of inserts were used from each type.

A cumulative breakage rate after 700 impacts (the rate in the number of inserts in which breakage was caused by 700 impacts) was checked. The result is shown below in Table 32.

(3) Wear Resistance Test

Each of the sample inserts was fastened to the leading end portion of a steel shank tool bar (holder) with a screw through a fixture, and a cutting tool was made.

By using the cutting tool, cutting tests were performed, in which dry cutting of alloy steel was intermittently performed at high speed, under the cutting conditions described below in Table 31.

The width of flank wear (amount of wear $V_B$) after a 4-minute process was measured. The results are shown in below in Table 32.

TABLE 31

| Cutting condition | Unit | Breakage resistance test Cumulative breakage rate after 700 impacts | Wear resistance test Amount of wear $V_B$ after 4-min process |
|---|---|---|---|
| Cutting speed | [m/min] | 200 | 300 |
| Feed f | [mm/rev] | 0.25 | 0.15 |
| Depth of cut | [mm] | 1.5 | 1.5 |
| Wet/Dry | | WET | WET |
| Number of impacts | [times] | 700 | — |
| Cutting time | [min] | — | 4 |
| Tip shape | | SNGN120408 | SNGN120408 |
| Cut material (work) | | SNCM439 (ϕ200 mm round bar: 4 grooves were cut and equally spaced in an axial direction) | SNCM439 (ϕ200 mm round bar) |

TABLE 32

| | Sample No. | Composition | Intermediate temperature | Cutting evaluation: Cumulative breakage rate [%] | Cutting evaluation: Amount of wear $V_B$ [mm] |
|---|---|---|---|---|---|
| Present embodiment | 1 | A | 1200 | 25 | 0.11 |
| | 2 | B | 1200 | 15 | 0.09 |
| | 3 | C | 1250 | 20 | 0.10 |
| | 4 | D | 1250 | 15 | 0.10 |
| Comparative examples | 5 | A | 1300 | 45 | 0.10 |
| | 6 | B | 1300 | 35 | 0.09 |
| | 7 | C | 1350 | 40 | 0.10 |
| | 8 | D | 1350 | 35 | 0.11 |

As clear from the aforementioned Tables 25-32, the inserts according to the present embodiment have a remarkable effect in which high wear resistance and high breakage resistance can be both achieved. This is particularly because, among W contained in each of the inserts, 40-65 mass % thereof is contained in the hard phases, and the rest of W is contained in the binding phase.

It is to be noted that the present invention is not limited to the above-described embodiments. It goes without saying that the present invention may be carried out in various ways without departing from the scope of the invention.

What is claimed is:

1. A cermet insert comprising:

a microstructure including a hard phase and a binding phase;

Ti, Nb and/or Ta, and W such that a sum of a converted amount of Ti converted into carbonitride, a converted amount of Nb and/or Ta converted into carbide, and a converted amount of W converted into carbide is 70-95 mass % of an entirety of the microstructure, and in which the converted amount of W converted into carbide is 15-35 mass % of the entirety of the microstructure; and Co and/or Ni as the sintered body composition, wherein the hard phase comprises one kind or two or more kinds of phases selected from (1)-(3) except for a singularity of (2), in which (1) a first hard phase is provided with a core-having structure in which a core portion includes a titanium carbonitride phase, and a peripheral portion includes a complex carbonitride phase comprising Ti, W, Ta and/or Nb (to be referred to (Ti, W, Ta/Nb)CN phase hereinafter), (2) a second hard phase is provided with a core-having structure in which both of a core portion and a peripheral portion include a (Ti, W, Ta/Nb)CN phase; and (3) a third hard phase is provided with a single-phase structure comprising a titanium carbonitride phase, and wherein the titanium carbonitride phase includes W-rich phases, which are rich in W as compared to a surrounding thereof, and unevenly distributed in the titanium carbonitride phase.

2. The cermet insert according to claim 1, wherein in the microstructure of at least one of a surface and a sectional surface of the cermet insert, the W-rich phases are unevenly distributed in the titanium carbonitride phase in at least one of a string-like manner and a mesh-like manner.

3. The cermet insert according to claim 1, wherein the W-rich phases are unevenly distributed in the titanium carbonitride phase in at least one of a laminar manner, a columnar manner, and a prismatic manner.

4. The cermet insert according to claim 1, wherein the hard phase and/or the binding phase contain(s) Mo.

5. The cermet insert according to claim 1, wherein the binding phase contains W as much as 40-60 mass % of an entirety of the binding phase.

6. A cutting tool comprising a holder provided with the cermet insert according to claim 1.

* * * * *